US009027315B2

(12) United States Patent
Tsutsumi et al.

(10) Patent No.: US 9,027,315 B2
(45) Date of Patent: May 12, 2015

(54) PACKING DEVICE

(75) Inventors: Ryosuke Tsutsumi, Kitakyushu (JP); Kenichi Motonaga, Kitakyushu (JP)

(73) Assignee: Kabushiki Kaisha Yaskawa Denki, Kitakyushu-Shi (JP)

( * ) Notice: Subject to any disclaimer, the term of this patent is extended or adjusted under 35 U.S.C. 154(b) by 725 days.

(21) Appl. No.: 13/356,650

(22) Filed: Jan. 24, 2012

(65) Prior Publication Data

US 2013/0036716 A1 Feb. 14, 2013

(30) Foreign Application Priority Data

Aug. 10, 2011 (JP) ..... 2011-175276
Sep. 27, 2011 (JP) ..... 2011-210618

(51) Int. Cl.

| | |
|---|---|
| ***B65B 43/26*** | (2006.01) |
| ***B65B 43/30*** | (2006.01) |
| ***B65B 43/32*** | (2006.01) |
| ***B65B 51/06*** | (2006.01) |
| ***B65B 7/20*** | (2006.01) |
| ***B31B 1/00*** | (2006.01) |
| ***B65B 5/04*** | (2006.01) |

(52) U.S. Cl.

CPC ..... *B65B 43/305* (2013.01); *B65B 43/325* (2013.01); *B65B 51/067* (2013.01); *B65B 7/20* (2013.01); *B31B 1/00* (2013.01); *B31B 2201/288* (2013.01); *B65B 5/04* (2013.01)

(58) Field of Classification Search

CPC ..... B31B 1/06; B31B 1/52; B31B 1/78
USPC ..... 53/564, 381.1, 382.2, 382.3, 387.1; 493/313; 901/40, 41

See application file for complete search history.

(56) References Cited

U.S. PATENT DOCUMENTS

| | | | | |
|---|---|---|---|---|
| 3,561,190 | A * | 2/1971 | Derenthal | 53/67 |
| 3,564,980 | A | 2/1971 | Winters | |
| 3,783,752 | A * | 1/1974 | Langen et al. | 493/18 |
| 4,044,527 | A * | 8/1977 | Ulrich et al. | 53/136.4 |

(Continued)

FOREIGN PATENT DOCUMENTS

| | | |
|---|---|---|
| JP | 11-070917 | 3/1999 |
| JP | 2005-001304 | 1/2005 |

(Continued)

OTHER PUBLICATIONS

Extended European Search Report for corresponding EP Application No. 12152980.4-2308, Nov. 9, 2012.

(Continued)

*Primary Examiner* — Gloria R Weeks
(74) *Attorney, Agent, or Firm* — Mori & Ward, LLP

(57) ABSTRACT

A packing device according to an embodiment includes a supply station, a right end effector, a left end effector, a right arm unit, a left arm unit, and a forming station. A cardboard box in a flat state is placed on the supply station. The cardboard box developed three-dimensionally is placed on the forming station. The right arm unit includes the right end effector provided with a suction unit. The left arm unit includes the left end effector provided with a suction unit. The packing device performs an operation of developing the cardboard box and an operation of moving the cardboard box to the forming station by using the right arm unit and the left arm unit while sucking both side surfaces of the cardboard box placed on the supply station by using the suction units.

23 Claims, 22 Drawing Sheets

(56) References Cited

U.S. PATENT DOCUMENTS

| | | | | | |
|---|---|---|---|---|---|
| 4,170,929 | A * | 10/1979 | McDowell | 493/313 |
| 4,554,042 | A * | 11/1985 | Marchetti | 156/350 |
| 4,585,504 | A * | 4/1986 | Marchetti | 156/351 |
| 4,633,642 | A * | 1/1987 | Lissoni | 53/136.4 |
| 4,732,644 | A * | 3/1988 | Chiu | 156/468 |
| 4,807,428 | A * | 2/1989 | Boisseau | 53/563 |
| 4,813,206 | A * | 3/1989 | DiRusso et al. | 53/136.4 |
| 4,951,445 | A * | 8/1990 | Thibault | 53/167 |
| 5,024,640 | A * | 6/1991 | Saitoh | 493/127 |
| 5,063,726 | A * | 11/1991 | Boisseau | 53/491 |
| 5,067,303 | A * | 11/1991 | Brookman et al. | 53/381.2 |
| 5,078,669 | A * | 1/1992 | Dietrich et al. | 493/315 |
| 5,105,600 | A * | 4/1992 | DePoint et al. | 53/468 |
| 5,223,075 | A * | 6/1993 | Sims | 156/468 |
| 5,514,068 | A * | 5/1996 | Calvert et al. | 493/315 |
| 5,536,231 | A * | 7/1996 | Nilsson | 493/315 |
| 6,079,187 | A * | 6/2000 | Velderman et al. | 53/436 |
| 6,179,004 | B1 * | 1/2001 | Davis, Jr. | 137/625.21 |
| 6,913,568 | B2 * | 7/2005 | Frank et al. | 493/309 |
| 6,915,622 | B2 * | 7/2005 | Spatafora | 53/458 |
| 7,409,812 | B2 * | 8/2008 | Gilmore et al. | 53/475 |
| 7,708,678 | B2 * | 5/2010 | Monti | 493/309 |
| 8,075,467 | B2 * | 12/2011 | Monti | 493/309 |
| 8,128,547 | B2 * | 3/2012 | Graham et al. | 493/313 |
| 8,621,831 | B2 * | 1/2014 | Moylan et al. | 53/504 |
| 2009/0291816 | A1 * | 11/2009 | Gebhardt et al. | 493/313 |
| 2011/0030318 | A1 | 2/2011 | Moylan et al. | |
| 2012/0083920 | A1 * | 4/2012 | Suyama et al. | 700/230 |
| 2013/0125517 | A1 * | 5/2013 | Gomi | 53/492 |

FOREIGN PATENT DOCUMENTS

| | | |
|---|---|---|
| JP | 2011-000669 | 1/2011 |
| WO | WO 03/024803 | 3/2003 |
| WO | WO 2007/088735 | 8/2007 |

OTHER PUBLICATIONS

Japanese Decision of a Patent Grant for corresponding JP Application No. 2011-210618, Aug. 6, 2013.

* cited by examiner

PACKING DEVICE

CROSS-REFERENCE TO RELATED APPLICATIONS

This application is based upon and claims the benefit of priority of the prior Japanese Patent Application No. 2011-175276, filed on Aug. 10, 2011; prior Japanese Patent Application No. 2011-210618, filed on Sep. 27, 2011, the entire contents of both of which are incorporated herein by reference.

FIELD

The embodiments discussed herein are directed to a packing device.

BACKGROUND

Conventionally, widely known are forming devices that form a cardboard box in a flat state into a box shape. Such a forming device develops the cardboard box in a flat state three-dimensionally, folds flaps, and joints both ends of the flaps thus folded with an adhesive tape or the like, thereby forming the cardboard box into a box shape.

In recent years, there has been developed a technology in which one robot performs not only the forming operation of a cardboard box described above, but also a series of packing operations such as an operation of storing products in the cardboard box thus formed and a sealing operation of the cardboard box in which the products are stored (e.g., Japanese Patent Application Laid-open No. H11-70917).

The robot disclosed in Japanese Patent Application Laid-open No. H11-70917 is a single-arm robot that includes one arm unit. The robot performs an operation of developing a cardboard box three-dimensionally by using a special end effector provided to a tip of the arm unit. The special end effector includes a suction mechanism and a folding mechanism. The suction mechanism sucks a first side surface of the cardboard box in a flat state and a second side surface adjacent to the first side surface. The folding mechanism folds the first side surface of the two side surfaces of the cardboard box sucked by the suction mechanism by an angle of 90 degrees with respect to the second side surface.

As described above, in the conventional technology, a series of packing operations are performed by using one robot, whereby the efficiency in the packing operations is improved. However, it is desirable that the efficiency in the packing operations be further improved.

SUMMARY

A packing device according to an aspect of embodiments includes a first work station, a first end effector, a second end effector, a first arm unit, a second arm unit, and a second work station. a packing material in a flat state is placed on the first work station. The first end effector and The second end effector includes a suction unit that sucks an object. The first arm unit includes the first end effector. The second arm unit includes the second end effector. The packing material developed three-dimensionally is placed on the second work station. The packing device performs an operation of developing the packing material and an operation of moving the packing material to the second work station by using the first arm unit and the second arm unit while both side surfaces of the packing material placed on the first work station are being sucked by using the suction unit included in the first end effector and the suction unit included in the second end effector.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Exemplary embodiments of a packing device disclosed in the present application are described below in greater detail with reference to the accompanying drawings. It is to be noted that the embodiments below are not intended to limit the present invention. In the description below, for example, an explanation will be made of an example in which a cardboard box is used as a packing material. However, the packing material is not limited to the cardboard box, and may be another packing material capable of being folded up in a flat state, such as a paper bag and an envelope.

Figure 1:
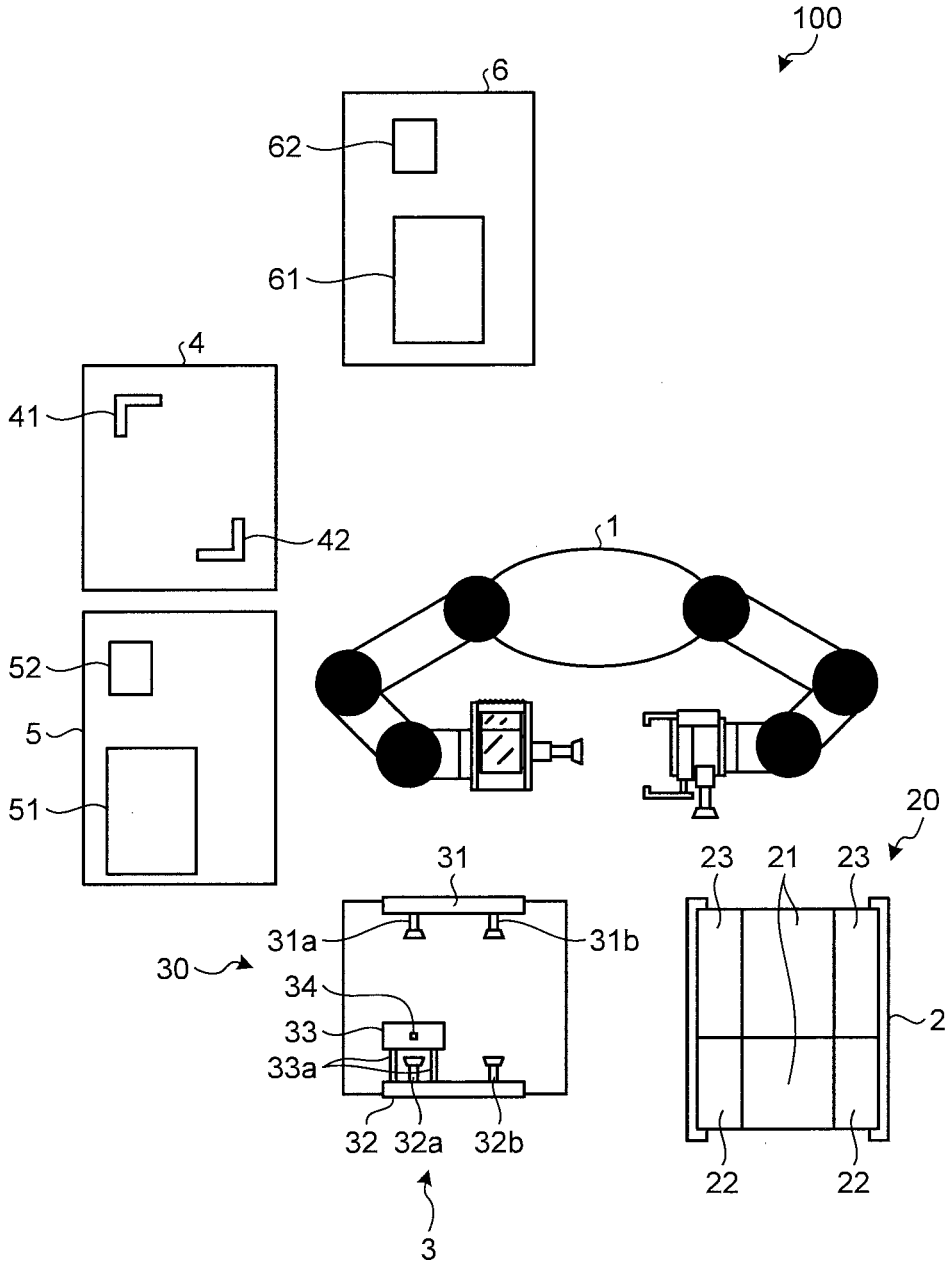
FIG. 1 is a schematic of an entire configuration of a packing device according to a first embodiment.

FIG. 1 is a schematic of an entire configuration of a packing device according to a first embodiment. As illustrated in FIG. 1, a packing device 100 according to the first embodiment includes a robot 1, a supply station 2, a forming station 3, a packing station 4, and stands 5 and 6. In the first embodiment, the supply station 2, the forming station 3, and the packing station 4 are examples of a first work station, a second work station, and a third work station, respectively.

The robot 1 is a dual-arm robot that includes two arms. The robot 1 is a typical general-purpose robot. In other words, by replacing an end effector provided to a tip of each of the arms depending on intended use, the robot 1 can be used for various types of operations. The specific configuration of the robot 1 will be described with reference to FIG. 2 and other drawings. Operations of the robot 1 are controlled by a control device, which is not illustrated.

The supply station 2 is a place on which a cardboard box 20 in a flat state is placed. The placement of the cardboard box 20 on the supply station 2 may be performed by a worker or may be performed by a conveying device such as a belt conveyor.

The cardboard box 20 is a typical cardboard box transformed into a rectangular parallelepiped box by being formed. Specifically, the cardboard box 20 includes a side surface 21, an inner flap 22, and an outer flap 23. The side surface 21 is a portion corresponds to a side wall of the cardboard box 20 formed into a box shape. The inner flap 22 and the outer flap 23 are provided to ends not being connected to another side surface 21 in each side surface 21. The outer flap 23 is a flap serving as a bottom surface or an upper surface of the cardboard box 20 thus formed. The inner flap 22 is a flap positioned on the inner side of the cardboard box 20 thus formed than the outer flap 23.

The forming station 3 is a place on which the cardboard box 20 developed three-dimensionally is placed. The forming station 3 includes a fixing device 30. The fixing device 30 supports the side surfaces 21 of the cardboard box 20 developed three-dimensionally, thereby fixing the cardboard box 20 in a manner suspended in the air. Specifically, the fixing device 30 includes a first supporting unit 31, a second supporting unit 32, a driving unit 33, and a detecting unit 34.

The first supporting unit 31 includes two suction units 31*a* and 31*b*. The second supporting unit 32 is arranged so as to face the first supporting unit 31, and includes two suction units 32*a* and 32*b* similarly to the first supporting unit 31. The suction units 31*a*, 31*b*, 32*a*, and 32*b* suck an object by using suction generated by a suction device such as a vacuum pump.

The driving unit 33 is arranged between the first supporting unit 31 and the second supporting unit 32, for example. The driving unit 33 moves a shaft 33*a* along the extending direction of the shaft 33*a* by using a driving device such as a motor. A tip of the shaft 33*a* is connected to the second supporting unit 32. Therefore, the driving unit 33 drives the shaft 33*a*, whereby the second supporting unit 32 moves toward the first supporting unit 31.

The detecting unit 34 is a proximity sensor that detects an object by using light or ultrasonic waves, for example. When the detecting unit 34 detects the cardboard box 20, the fixing device 30 drives the driving unit 33, thereby causing the second supporting unit 32 to move toward the first supporting unit 31.

In the forming station 3, to form the bottom surface of the cardboard box 20, the robot 1 performs an operation of folding the inner flaps 22 and the outer flaps 23 and an operation of applying an adhesive tape to both ends of the outer flaps 23 thus folded. The method for fixing the cardboard box 20 to the fixing device 30 and specific contents of the operation of folding the inner flaps 22 and the outer flaps 23 and other operations will be described later.

The packing station 4 is a place on which the cardboard box 20 whose bottom surface is formed is placed. In the packing station 4, the robot 1 performs an operation of storing various types of products in the cardboard box 20. The packing station 4 includes guides 41 and 42 for positioning the cardboard box 20.

The stands 5 and 6 are stands on which the various types of products to be stored in the cardboard box 20 are placed. For example, a liner 51 and a workpiece 52 are placed on the stand 5. Furthermore, a liner 61 and a workpiece 62 are placed on the stand 6. The liners 51 and 61 are members having a size nearly equal to that of the bottom surface of the cardboard box 20 formed into a box shape. Specific contents of the storing operation performed by the robot 1 will be described later.

The packing device 100 is configured as described above. The robot 1, which is a dual-arm robot, moves the cardboard box 20 from the supply station 2 to the forming station 3 while developing the cardboard box 20 in a flat state three-dimensionally by using both the arms. Furthermore, the robot 1 performs the operation of folding the inner flaps 22 and the outer flaps 23 and the operation of applying the adhesive tape to the outer flaps 23 thus folded in the forming station 3. Moreover, the robot 1 performs the operation of storing products in the cardboard box 20 and a sealing operation of the cardboard box 20 in the packing station 4.

As described above, in the packing device 100 according to the present embodiment, the robot 1, which is a dual-arm robot, performs a series of packing operations. The configuration of the robot 1 and the operation performed by the robot 1 in each of the stations will be explained specifically.

Figure 2:
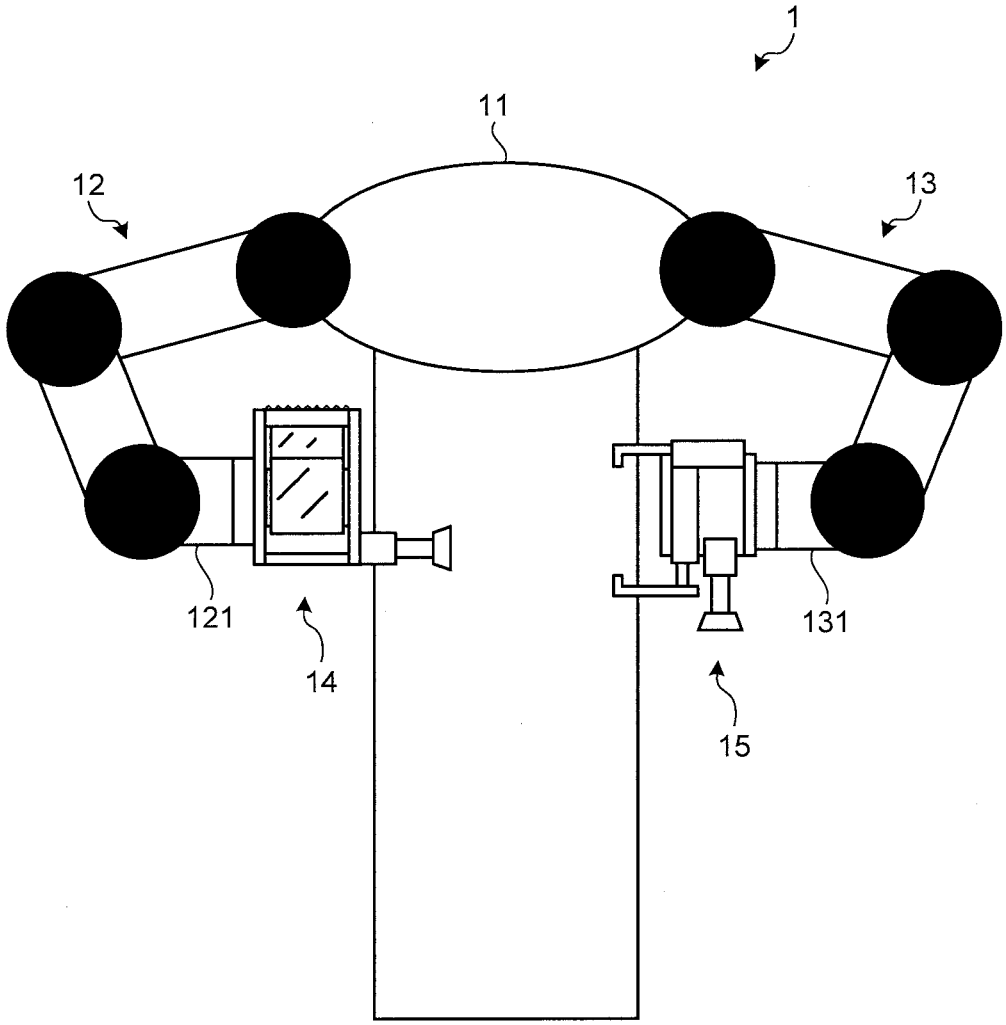
FIG. 2 is a schematic of a configuration of a robot according to the first embodiment.

FIG. 2 is a schematic of the configuration of the robot 1 according to the first embodiment. As illustrated in FIG. 2, the robot 1 is a dual-arm robot including a right arm unit 12 and a left arm unit 13 as both the arms.

Specifically, the robot 1 includes a main body unit 11, the right arm unit 12, the left arm unit 13, a right end effector 14, and a left end effector 15. In the first embodiment, the right arm unit 12 and the left arm unit 13 are examples of a first arm unit and a second arm unit, respectively. Furthermore, in the first embodiment, the right end effector 14 and the left end effector 15 are examples of a first end effector and a second end effector, respectively.

The right arm unit 12 and the left arm unit 13 are multiaxis robots each including a plurality of joint axes. The right arm unit 12 and the left arm unit 13 are attached to both shoulder portions of the main body unit 11. The main body unit 11 is also configured in a rotatable manner about the body.

Figure 3A:
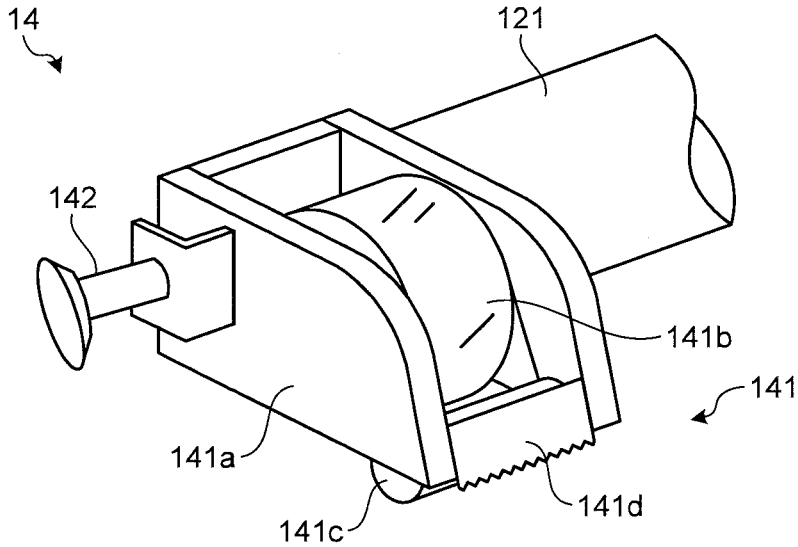
FIG. 3A is a schematic of a configuration of a right end effector according to the first embodiment.
Figure 3B:
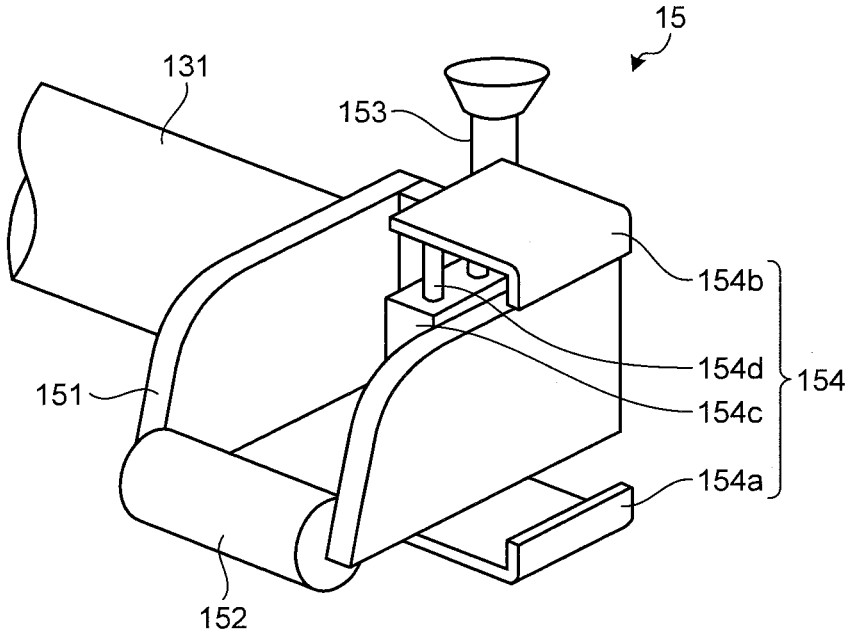
FIG. 3B is a schematic of a configuration of a left end effector according to the first embodiment.

The right end effector 14 is provided to an arm tip portion 121 of the right arm unit 12. The left end effector 15 is provided to an arm tip portion 131 of the left arm unit 13. The configurations of the right end effector 14 and the left end effector 15 will now be described with reference to FIG. 3A and FIG. 3B. FIG. 3A is a schematic of the configuration of the right end effector 14 according to the first embodiment. FIG. 3B is a schematic of the configuration of the left end effector 15 according to the first embodiment.

As illustrated in FIG. 3A, the right end effector 14 includes an applying unit 141 and a suction unit 142. The applying unit 141 includes a casing 141*a*, a tape main body 141*b*, a roller 141*c*, and a cutting unit 141*d*.

The casing 141*a* includes side walls covering both side surfaces of the tape main body 141*b* and a shaft (not illustrated) arranged horizontally between the side walls.

The tape main body 141*b* is a member obtained by winding an adhesive tape in layers around a ring-shaped core. The tape main body 141*b* is attached to the casing 141*a* in a rotatable manner with the shaft of the casing 141*a* inserted into the core.

The roller 141*c* is a cylindrical member attached in a rotatable manner between the two side walls of the casing 141*a*. The roller 141*c* presses the adhesive tape extracted from the tape main body 141*b* against the cardboard box 20 to which the adhesive tape is to be applied. The cutting unit 141*d* is a cutter arranged between the two side walls of the casing 141*a*. The cutting unit 141*d* cuts the adhesive tape extracted from the tape main body 141*b*.

The suction unit 142 sucks an object by using suction generated by a suction device such as a vacuum pump. The suction unit 142 is provided to the side wall of the casing 141*a*, for example.

By contrast, as illustrated in FIG. 3B, the left end effector 15 includes a casing 151, a pressing unit 152, a suction unit 153, and a holding unit 154.

The casing 151 is a casing having a shape nearly the same as that of the casing 141*a* included in the right end effector 14, and includes two side walls arranged so as to face each other with a predetermined space interposed therebetween. The pressing unit 152 is a cylindrical member arranged between the two side walls of the casing 151. As will be explained later, the pressing unit 152 is used for fixing the adhesive tape to the cardboard box 20 securely.

The suction unit 153 is a suction unit similar to the suction unit 142 included in the right end effector 14. In other words, the suction unit 153 sucks an object by using suction generated by a suction device such as a vacuum pump. The suction unit 153 is provided between the side walls of the casing 151, for example.

The suction unit 142 included in the right end effector 14 and the suction unit 153 included in the left end effector 15 are used for an operation of developing the cardboard box 20 in a flat state three-dimensionally, an operation of storing the workpiece 62 or the like having a relatively light weight in the cardboard box 20 whose bottom portion is formed, and other operations.

The holding unit 154 is used for storing the workpiece 52 having a weight incapable of being held by the suction units 142 and 153, for example. Specifically, the holding unit 154 includes a first hook unit 154*a*, a second hook unit 154*b*, a driving unit 154*c*, and a shaft 154*d*.

The holding unit 154 moves the shaft 154*d* along the extending direction thereof by using the driving unit 154*c*. Thus, the second hook unit 154*b* connected to the shaft 154*d* moves toward the first hook unit 154*a*. As a result, an object positioned between the first hook unit 154*a* and the second hook unit 154*b* is sandwiched and supported by the first hook unit 154*a* and the second hook unit 154*b*.

In the present embodiment, an explanation will be made of the case where the right end effector 14 includes the applying unit 141, and the left end effector 15 includes the pressing unit 152 and the holding unit 154. However, the right end effector 14 may include the pressing unit 152 and the holding unit 154, and the left end effector 15 may include the applying unit 141.

Figure 4A:
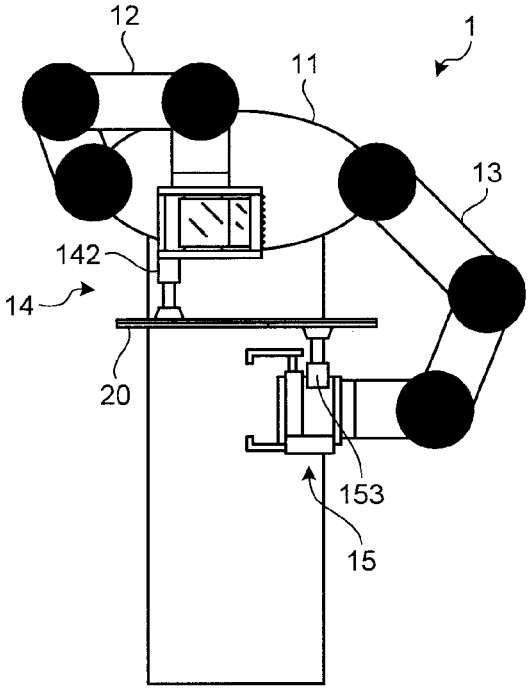
FIG. 4A and FIG. 4B are views for explaining a developing operation of a cardboard box.
Figure 4B:
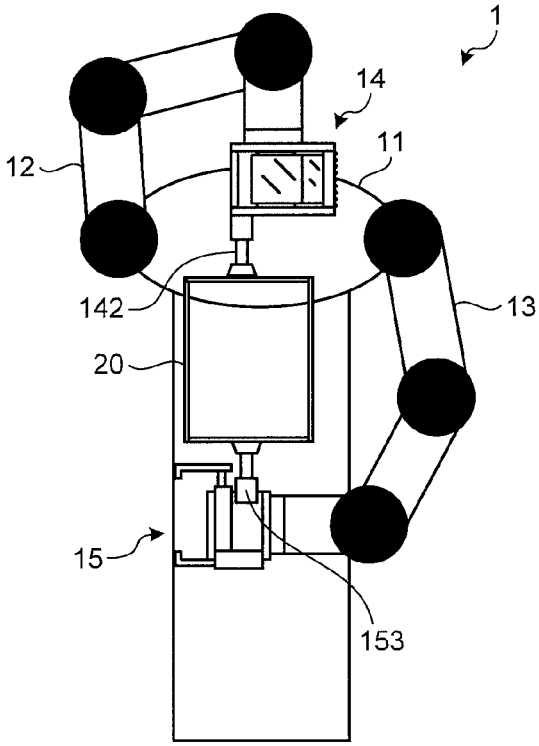

The developing operation of developing the cardboard box 20 in a flat state three-dimensionally will now be described with reference to FIG. 4A and FIG. 4B. FIG. 4A and FIG. 4B are views for explaining the developing operation of the cardboard box 20 performed by the robot 1.

First, the robot 1 takes out the cardboard box 20 in a flat state from the supply station 2. At this time, as illustrated in FIG. 4A, the robot 1 sucks both surfaces of the cardboard box 20 placed on the supply station 2 by using the suction unit 142 included in the right end effector 14 and the suction unit 153 included in the left end effector 15.

The robot 1, for example, sucks the upper surface of the cardboard box 20 in a flat state by using the suction unit 142 of the right end effector 14, and sucks the lower surface thereof by using the suction unit 153 of the left end effector 15. To prevent the cardboard box 20 from floating, the robot 1 sucks the upper surface of the cardboard box 20 prior to the lower surface.

Subsequently, as illustrated in FIG. 4B, the robot 1 drives the right arm unit 12 and the left arm unit 13 while the suction units 142 and 153 are sucking both surfaces of the cardboard box 20, thereby developing the cardboard box 20 in a flat state three-dimensionally.

In this example, both the right arm unit 12 and the left arm unit 13 are driven. However, while the position of one of the arm units (e.g., left arm unit 13) is being fixed, the other of the arm units (e.g., right arm unit 12) alone may be driven.

Furthermore, the robot 1 moves the cardboard box 20 to the forming station 3 by using the right arm unit 12 and the left arm unit 13. The robot 1 may start the operation of moving the cardboard box 20 to the forming station 3 after finishing the operation of developing the cardboard box 20. Alternatively, the robot 1 may perform the operation of developing the cardboard box 20 and the operation of moving the cardboard box 20 to the forming station 3 in parallel.

As described above, the packing device 100 according to the first embodiment performs the operation of developing the cardboard box 20 three-dimensionally by using the two arm units 12 and 13.

In the conventional technology, a robot that performs a developing operation of a cardboard box is a single-arm robot including one arm unit. To perform the developing operation of the cardboard box by one end effector, the robot in the conventional technology uses an end effector having not only a suction mechanism, but also a folding mechanism for folding a side surface of the cardboard box by an angle of 90 degrees with respect to another side surface adjacent thereto.

As described above, in the end effector used in the conventional technology, the mechanism for developing the cardboard box is complex and large in size. As a result, there may be no room for adding other mechanisms for performing subsequent operations to the end effector. Therefore, in the conventional technology, if the robot performs the subsequent operations, the end effector may need to be replaced. Furthermore, in the conventional technology, because a special mechanism such as the folding mechanism is used, costs required for the end effector may increase.

By contrast, the packing device 100 according to the first embodiment performs the developing operation of the cardboard box 20 by using the arm unit used only for moving the cardboard box in the conventional technology as well. Therefore, the packing device 100 according to the first embodiment can perform the developing operation without using a special mechanism such as the folding mechanism. In other words, the packing device 100 according to the first embodiment can simplify the configuration of the end effector for the developing operation.

If the configuration of the end effector is simplified, it is possible to add other mechanisms, such as an applying unit, a holding unit, and a roller, to the end effector in a simple manner. Furthermore, because no special mechanism such as the folding mechanism is used, it is possible to reduce the costs required for the end effector. Therefore, the packing device 100 according to the first embodiment can improve the efficiency in the packing operations.

The robot 1 performs the operation of developing the cardboard box 20 and the operation of moving the cardboard box 20 to the forming station 3 in parallel, thereby further improving the efficiency in the packing operations.

Figure 5A:
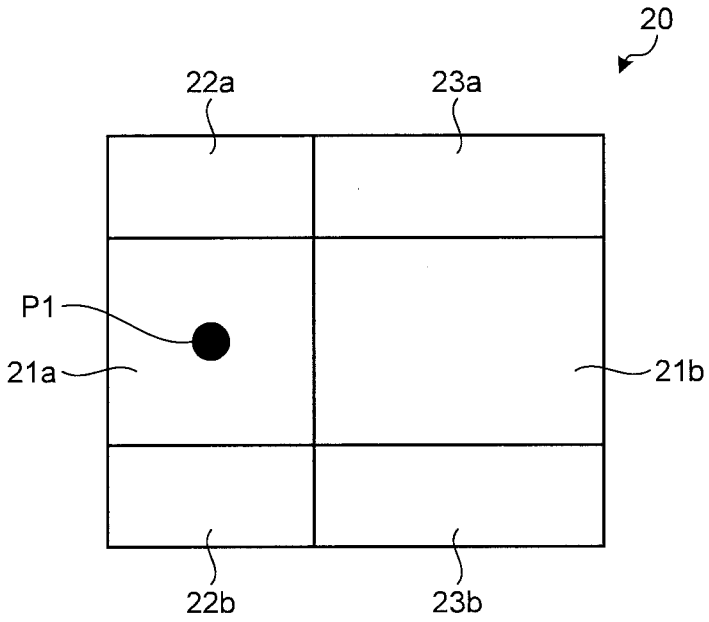
FIG. 5A and FIG. 5B are schematics of positions sucked by suction units.
Figure 5B:
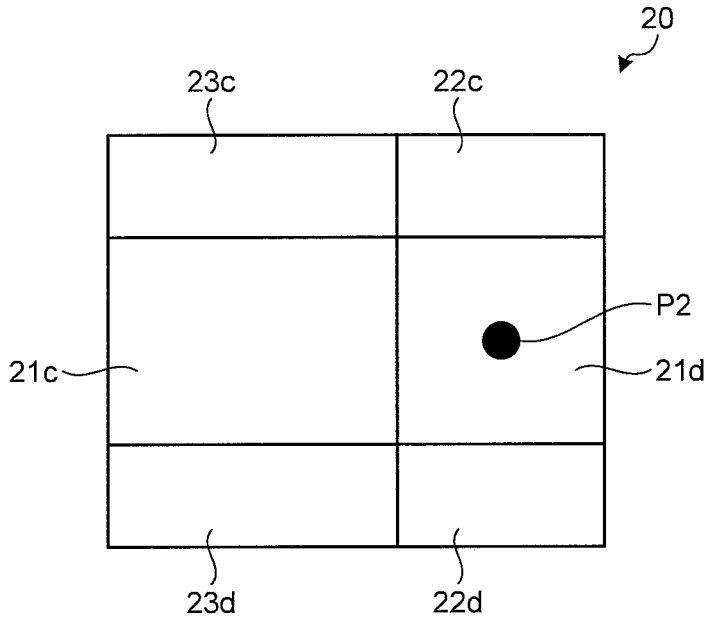

The positions on the cardboard box 20 sucked by the suction unit 142 included in the right end effector 14 and the suction unit 153 included in the left end effector 15 will now be described with reference to FIG. 5A and FIG. 5B. FIG. 5A and FIG. 5B are schematics of the positions sucked by the suction units 142 and 153. FIG. 5A illustrates the upper surface of the cardboard box 20 placed on the supply station 2. FIG. 5B illustrates the lower surface of the cardboard box 20 placed on the supply station 2.

In the description below, as illustrated in FIG. 5A and FIG. 5B, side surfaces 21 positioned on the upper surface side among four side surfaces 21 of the cardboard box 20 are referred to as side surfaces 21*a* and 21*b*, whereas side surfaces 21 positioned on the lower surface side are referred to as side surfaces 21*c* and 21*d*. When the cardboard box 20 is developed three-dimensionally, the side surface 21*a* is positioned opposite to the side surface 21*d*. Furthermore, when the cardboard box 20 is developed three-dimensionally, the side surface 21*b* is positioned opposite to the side surface 21*c*.

In the description below, inner flaps 22 adjacent to the side surface 21*a* are referred to as inner flaps 22*a* and 22*b*, whereas outer flaps 23 adjacent to the side surface 21*b* are referred to as outer flaps 23*a* and 23*b*. Similarly, in the description below, outer flaps 23 adjacent to the side surface 21*c* are referred to as outer flaps 23*c* and 23*d*, whereas inner flaps 22 adjacent to the side surface 21*d* are referred to as inner flaps 22*c* and 22*d*.

As illustrated in FIG. 5A, the robot 1 sucks a center point P1 in the side surface 21*a* among the side surfaces 21*a* to 21*d* of the cardboard box 20 by using the suction unit 142 of the right end effector 14. Furthermore, as illustrated in FIG. 5B, the robot 1 sucks a center point P2 in the side surface 21*d* positioned opposite to the side surface 21*a* when the cardboard box 20 is developed three-dimensionally among the side surfaces 21*a* to 21*d* of the cardboard box 20 by using the suction unit 153 of the left end effector 15.

As described above, the suction units 142 and 153 suck the side surfaces positioned opposite to each other when the cardboard box 20 is developed three-dimensionally among the side surfaces 21*a* to 21*d* of the cardboard box 20 in a flat state. With this configuration, it is possible to develop the cardboard box 20 by a simple operation compared with the case where the suction units 142 and 153 suck the side surfaces adjacent to each other (e.g., the side surface 21*a* and the side surface 21*b*) among the side surfaces 21*a* to 21*d* of the cardboard box 20.

Furthermore, because the robot 1 sucks the center points in the side surfaces of the cardboard box 20, it is possible to perform the developing operation of the cardboard box 20 stably. The robot 1 may suck a position other than the center points.

In this example, the robot 1 sucks the side surface 21*a* and the side surface 21*d* of the cardboard box 20. However, the robot 1 may suck the side surface 21*b* and the side surface 21*c* of the cardboard box 20. Furthermore, the robot 1 may suck the side surface positioned on the upper surface side by using the suction unit 153 of the left end effector 15, and suck the side surface positioned on the lower surface side by using the suction unit 142 of the right end effector 14.

The forming operation of the cardboard box 20 performed in the forming station 3 will now be described. In the forming station 3, the operation of fixing the cardboard box 20 by using the fixing device 30, the operation of folding the inner flaps 22 and the outer flaps 23, and the operation of jointing both ends of the outer flaps 23 with the adhesive tape are performed as the forming operation.

Figure 6A:
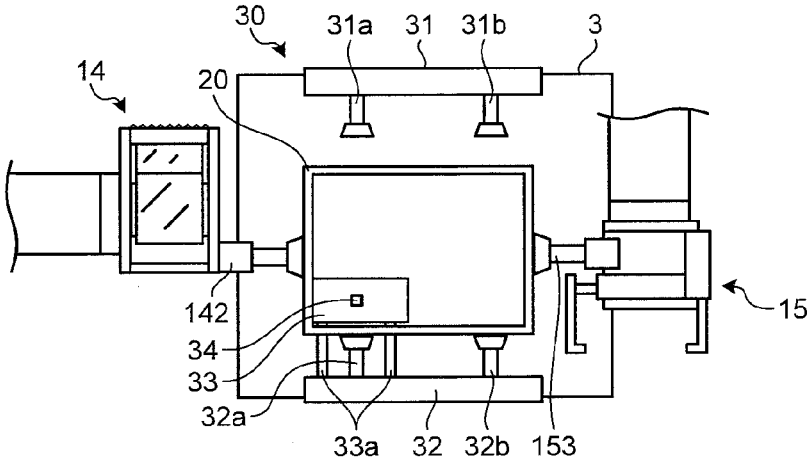
FIG. 6A to FIG. 6C are views for explaining an operation of fixing the cardboard box by using a fixing device.
Figure 6B:
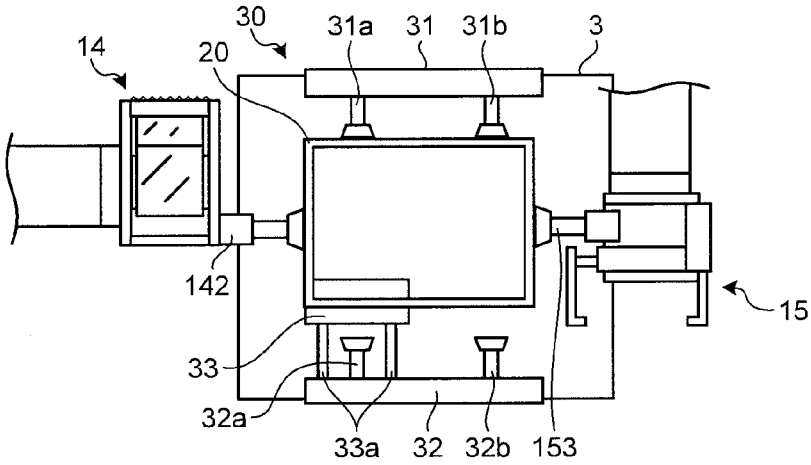
Figure 6C:
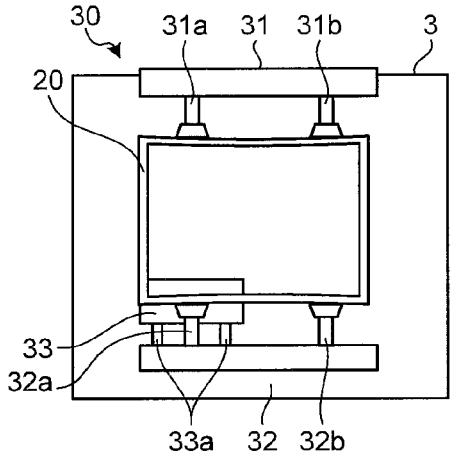

The operation of fixing the cardboard box 20 by using the fixing device 30 will now be described with reference to FIG. 6A to FIG. 6C. FIG. 6A to FIG. 6C are views for explaining the operation of fixing the cardboard box 20 by using the fixing device 30.

As illustrated in FIG. 6A, the robot 1 places the cardboard box 20 developed three-dimensionally in a space between the first supporting unit 31 and the second supporting unit 32 of the fixing device 30. At this time, the robot 1 places the cardboard box 20 such that the side surfaces 21 (side surfaces 21*b* and 21*d* illustrated in FIG. 5A and FIG. 5B) to which the outer flaps 23 are provided face the first supporting unit 31 and the second supporting unit 32, respectively.

Subsequently, as illustrated in FIG. 6B, the robot 1 moves the cardboard box 20 to a position at which the side surface of the cardboard box 20 comes into contact with the suction units 31*a* and 31*b* of the first supporting unit 31.

If the side surface of the cardboard box 20 comes into contact with the suction units 31*a* and 31*b* of the first supporting unit 31, the detecting unit 34 detects the cardboard box 20. If the detecting unit 34 detects the cardboard box 20, the driving unit 33 moves the second supporting unit 32 toward the first supporting unit 31. After moving the second supporting unit 32, the fixing device 30 sucks the side surfaces 21 of the cardboard box 20 by using the suction units 31*a*, 31*b*, 32*a*, and 32*b*. As a result, the cardboard box 20 is fixed by the fixing device 30 as illustrated in FIG. 6C.

At this time, as illustrated in FIG. 6C, the cardboard box 20 is fixed by the fixing device 30 with the side surfaces 21 of the cardboard box 20 to which the outer flaps 23 are provided bent inward by pressure applied from the second supporting unit 32.

Figure 7:
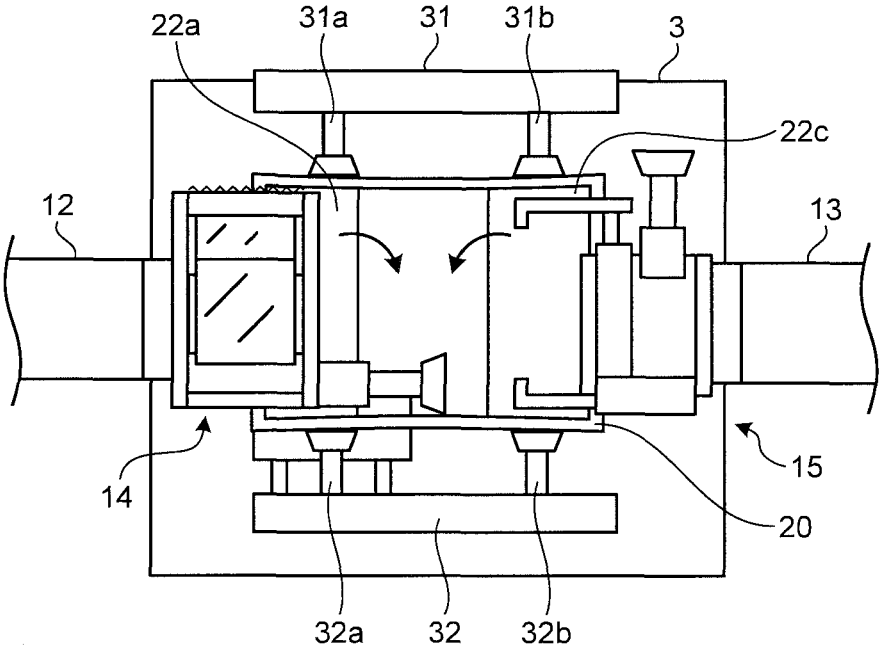
FIG. 7 is a view for explaining an operation of folding inner flaps.

The operation of folding the inner flaps 22 will now be described with reference to FIG. 7. FIG. 7 is a view for explaining the operation of folding the inner flaps 22. An explanation will be made of the operation of folding the inner flaps 22*a* and 22*c* among the inner flaps 22*a* to 22*d* illustrated in FIGS. 5A and 5B.

As illustrated in FIG. 7, the robot 1 folds the inner flaps 22*a* and 22*c* toward the inside of the cardboard box 20 by using the right arm unit 12 and the left arm unit 13. The robot 1, for example, drives the right arm unit 12 with the right end effector 14 brought into contact with the inner flap 22*a*, thereby folding the inner flap 22*a* toward the inside of the cardboard box 20. Furthermore, the robot 1 drives the left arm unit 13 with the left end effector 15 brought into contact with the inner flap 22*c*, thereby folding the inner flap 22*c* toward the inside of the cardboard box 20.

As is explained with reference to FIG. 6C, the cardboard box 20 is fixed by the fixing device 30 with the side surfaces 21 of the cardboard box 20 to which the outer flaps 23 are provided bent inward. Therefore, the inner flaps 22*a* and 22*c* folded toward the inside of the cardboard box 20 get stuck with the side surfaces 21 of the cardboard box 20. Thus, it is possible to prevent the cardboard box 20 from rebounding outward.

As described above, in the packing device 100 according to the first embodiment, the forming station 3 includes the fixing device 30 (corresponding to a pressing unit) that presses the side surfaces 21 (side surfaces 21*b* and 21*c* illustrated in FIG. 5A and FIG. 5B) of the cardboard box 20 to which the outer flaps 23 are provided from outside of the cardboard box 20. Furthermore, in the packing device 100 according to the first embodiment, the right arm unit 12 and the left arm unit 13 fold the inner flaps 22 toward the inside of the cardboard box 20 pressed by the fixing device 30. Therefore, the packing device 100 according to the first embodiment can facilitate the operation of folding the inner flaps 22.

The position at which the right end effector 14 is brought into contact with the inner flap 22*a* and the position at which the left end effector 15 is brought into contact with the inner flap 22*c* may be arbitrary positions.

Figure 8A:
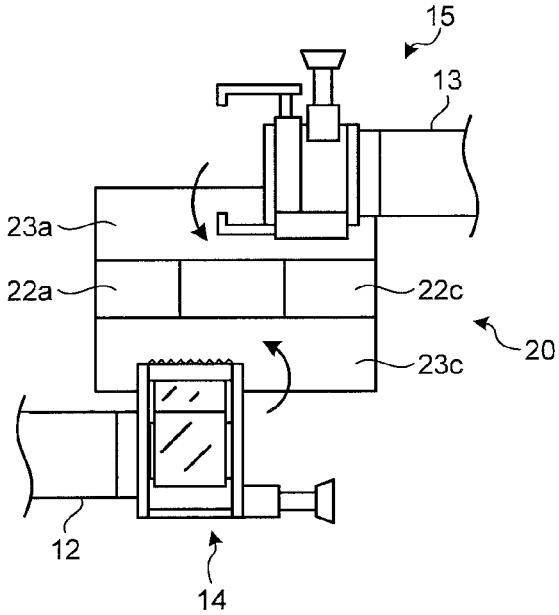
FIG. 8A to FIG. 8C are views for explaining an operation of folding outer flaps.
Figure 8B:
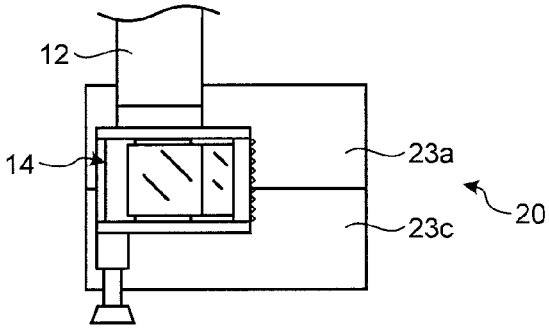
Figure 8C:
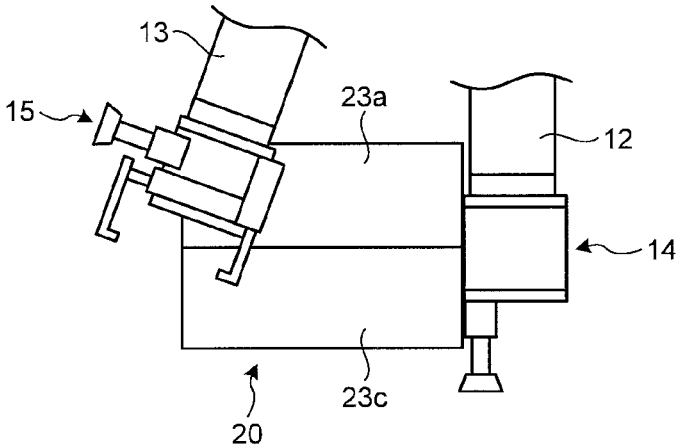

The operation of folding the outer flaps 23 will now be described with reference to FIG. 8A to FIG. 8C. FIG. 8A to FIG. 8C are views for explaining the operation of folding the outer flaps 23. To facilitate understanding, illustration of the fixing device 30 is omitted in FIG. 8A to FIG. 8C. An explanation will be made of the operation of folding the outer flaps 23*a* and 23*c* among the outer flaps 23*a* to 23*d* illustrated in FIG. 5A and FIG. 5B.

As illustrated in FIG. 8A, the robot 1 folds the outer flaps 23*a* and 23*c* halfway by using the right arm unit 12 and the left arm unit 13. Subsequently, as illustrated in FIG. 8B, the robot 1 completely folds the outer flaps 23*a* and 23*c* folded halfway by using the right arm unit 12 alone. As a result, the outer flap 23*a* and the outer flap 23*c* come into contact with each other at the ends.

Subsequently, as illustrated in FIG. 8C, the robot 1 moves the right arm unit 12 to the side surface 21*d* of the cardboard box 20 (refer to FIG. 5C) to which the inner flap 22*c* is provided while holding down the outer flaps 23*a* and 23*c* by the right end effector 14.

At this time, the robot 1 holds down the outer flaps 23*a* and 23*c* by using the left arm unit 13 prior to moving the right end effector 14 to the side surface 21*d*. With this configuration, it is possible to prevent the outer flaps 23*a* and 23*c* from rebounding.

The right arm unit 12 starts the applying operation of the adhesive tape from the position illustrated in FIG. 8C, that is, from the side surface 21*d* of the cardboard box 20 to which the inner flap 22*c* is provided.

Figure 9A:
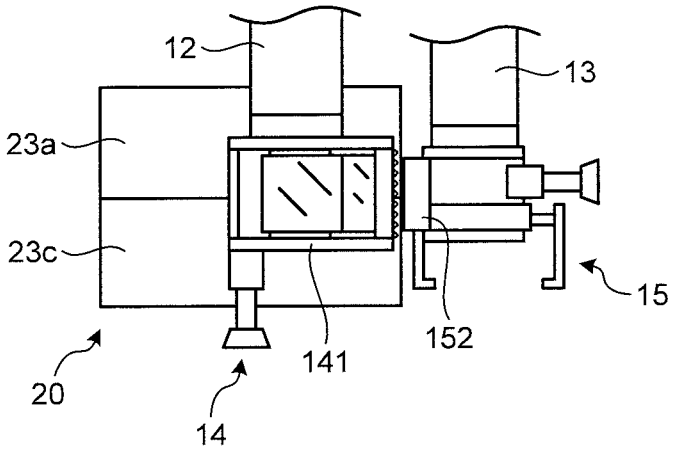
FIG. 9A and FIG. 9B are views for explaining an operation of applying an adhesive tape.
Figure 9B:
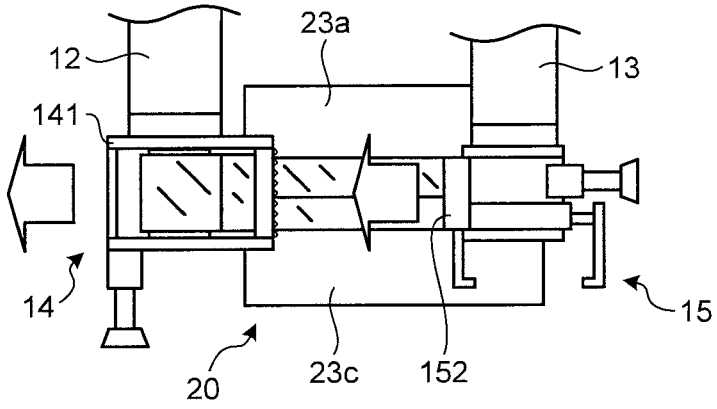

The operation of jointing both ends of the outer flaps 23*a* and 23*c* with the adhesive tape will now be described with reference to FIG. 9A and FIG. 9B. FIG. 9A and FIG. 9B are views for explaining the operation of applying the adhesive tape. To facilitate understanding, illustration of the fixing device 30 is omitted in FIG. 9A and FIG. 9B.

As illustrated in FIG. 9A and FIG. 9B, the robot 1 applies the adhesive tape to both end portions of the outer flaps 23*a* and 23*c* by using the applying unit 141 provided to the right end effector 14 and the right arm unit 12. Specifically, the robot 1 applies the adhesive tape from the position illustrated in FIG. 8C to the side surface 21*a* (refer to FIG. 5A) on the opposite side via the outer flaps 23*a* and 23*c*.

Furthermore, the robot 1 presses the adhesive tape applied to the cardboard box 20 by using the pressing unit 152 provided to the left end effector 15 and the left arm unit 13 such that the pressing unit 152 follows the applying unit 141.

As described above, the right arm unit 12 applies the adhesive tape by using the applying unit 141 to both end portions of the pair of outer flaps 23*a* and 23*c* folded such that the end portions thereof come into contact with each other. Furthermore, the left arm unit 13 presses the adhesive tape applied to the cardboard box 20 by the right arm unit 12. With this configuration, it is possible to apply the adhesive tape to the cardboard box 20 securely.

As illustrated in FIG. 8C, the left arm unit 13 presses the pair of outer flaps 23*a* and 23*c* folded such that the end portions thereof come into contact with each other while the right arm unit 12 is applying the adhesive tape to the side surface 21*d* of the cardboard box 20 to which the inner flap 22*c* is provided. Therefore, it is possible to prevent the outer flaps 23*a* and 23*c* from rebounding.

When the operation of applying the adhesive tape to the outer flaps 23*a* and 23*c* is completed, the bottom surface of the cardboard box 20 is formed by the outer flaps 23*a* and 23*c*. The robot 1 sucks the cardboard box 20 whose bottom surface is formed by using the suction units 142 and 153, and moves the cardboard box 20 to the packing station 4 by using the right arm unit 12 and the left arm unit 13.

Figure 10A:
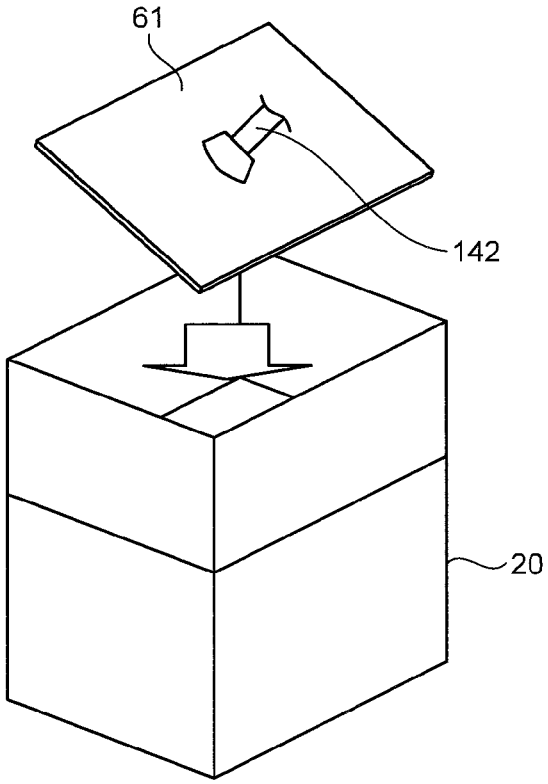
FIG. 10A and FIG. 10B are views for explaining a storing operation.
Figure 10B:
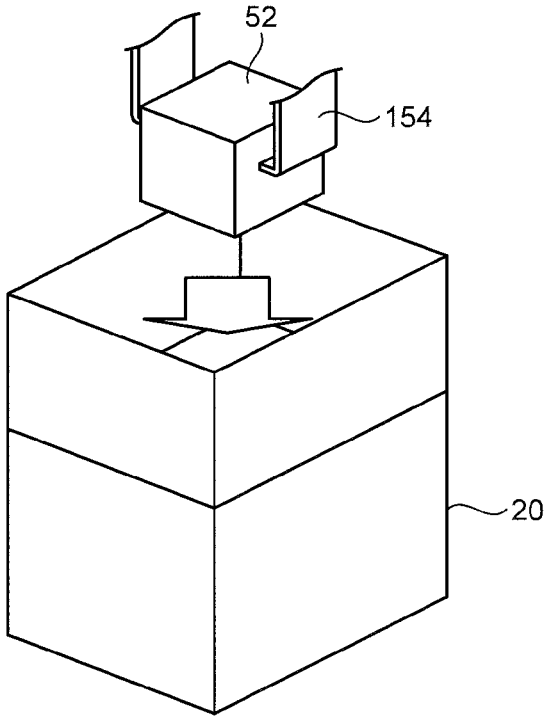

The storing operation performed in the packing station 4 will now be described with reference to FIG. 10A and FIG. 10B. FIG. 10A and FIG. 10B are views for explaining the storing operation.

After placing the cardboard box 20 on the packing station 4, the robot 1 performs the operation of storing products in the cardboard box 20 by using the right arm unit 12 and the left arm unit 13.

As illustrated in FIG. 10A, for example, the robot 1 sucks the liner 61 (refer to FIG. 1) placed on the stand 6 in advance by using the suction unit 142 provided to the right end effector 14. Subsequently, after moving the liner 61 to a position above the cardboard box 20 by using the right arm unit 12, the robot stops the suction performed by the suction unit 142, thereby placing the liner 61 on the bottom surface of the cardboard box 20.

As illustrated in FIG. 10A, the robot 1 drops the liner 61 sucked by using the suction unit 142 toward the bottom surface of the cardboard box 20 with the liner 61 tilted with respect to the bottom surface of the cardboard box 20. With this configuration, it is possible to place the liner 61 produced in the size nearly equal to that of the bottom surface of the cardboard box 20 in a simple manner.

In this example, the right arm unit 12 places the liner 61 on the bottom surface of the cardboard box 20 by using the suction unit 142. However, the left arm unit 13 may place the liner 61 on the bottom surface of the cardboard box 20 by using the suction unit 153.

Furthermore, as illustrated in FIG. 10B, the robot 1 holds the workpiece 52 (refer to FIG. 1) placed on the stand 5 by using the holding unit 154 provided to the left end effector 15. Subsequently, the robot 1 stores the workpiece 52 in the cardboard box 20 by using the left arm unit 13.

As described above, the left end effector 15 includes the holding unit 154 for holding a product in addition to the suction unit 153. Therefore, the robot 1 can store a workpiece having a weight or a shape incapable of being held by the suction units 142 and 153 in the cardboard box 20.

While the left end effector 15 includes the holding unit 154 in this example, the right end effector 14 may include the holding unit.

The robot 1 may move a product having a relatively light weight such as the workpiece 62 to the cardboard box 20 by using the suction units 142 and 153, which is not explained herein. Furthermore, after storing the workpieces 52 and 62 in the cardboard box 20, the robot 1 performs operations of sucking the liner 51 by using the suction unit 153, for example, and placing the liner 51 on the workpieces 52 and 62 in the cardboard box 20.

Figure 11A:
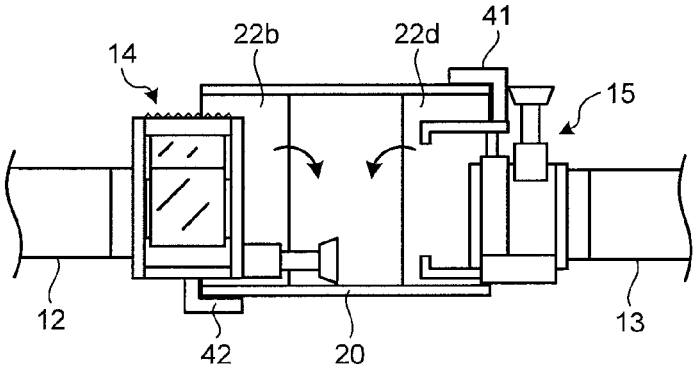
FIG. 11A to FIG. 11C are views for explaining an operation of sealing the cardboard box.
Figure 11B:
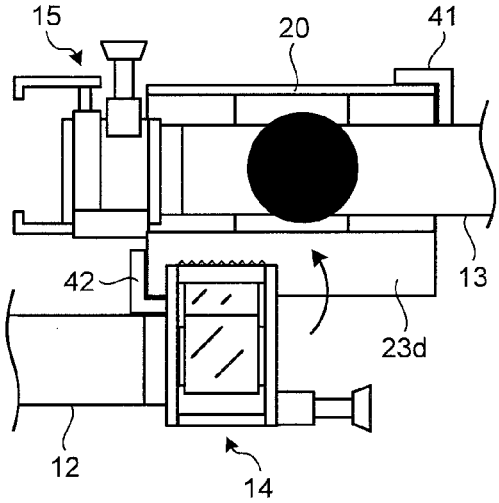
Figure 11C:
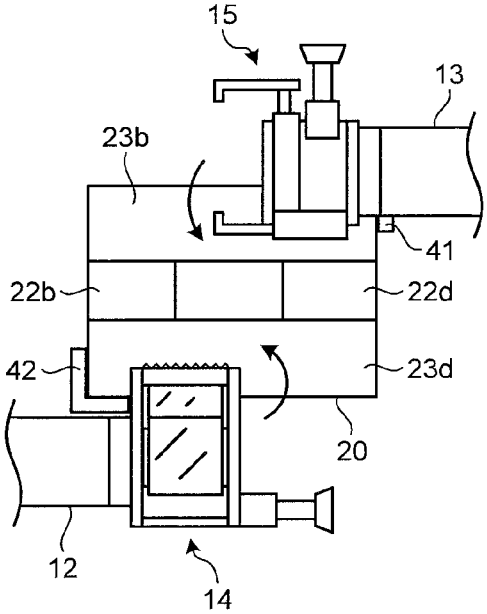

The sealing operation of the cardboard box 20 performed in the packing station 4 will now be described with reference to FIG. 11A to FIG. 11C. FIG. 11A to FIG. 11C are views for explaining the operation of sealing the cardboard box 20.

As illustrated in FIG. 11A, the robot 1 folds the inner flaps 22*b* and 22*d* by using the right arm unit 12 and the left arm unit 13 in the same manner as in the operation explained with reference to FIG. 7.

The packing station 4 does not include the fixing device 30 included in the forming station 3. In other words, the side surfaces 21 of the cardboard box 20 to which the outer flaps 23 are provided is not bent inward in the cardboard box 20. As a result, there is a possibility that the inner flaps 22*b* and 22*d* folded toward the inside of the cardboard box 20 rebound outward.

Therefore, after folding the inner flaps 22*b* and 22*d*, the robot 1 holds down the inner flaps 22*b* and 22*d* by using the left arm unit 13, for example, as illustrated in FIG. 11B. With this configuration, it is possible to prevent the inner flaps 22*b* and 22*d* from rebounding without using the fixing device 30.

Furthermore, the robot 1 folds the outer flap 23*d* halfway by using the right arm unit 12 while holding down the inner flaps 22*b* and 22*d* by the left arm unit 13. As a result, the inner flaps 22*b* and 22*d* are held down by the outer flap 23*d*. After creating such a state, the robot 1 removes the left arm unit 13 from the inner flaps 22*b* and 22*d*, and folds the outer flap 23*d* halfway by using the left arm unit 13.

Subsequently, the robot 1 applies the adhesive tape to both end portions of the outer flaps 23*b* and 23*d* by the same operation as the operation explained with reference to FIG. 8A to FIG. 8C. As a result, the cardboard box 20 is sealed.

In this example, the left arm unit 13 holds down the inner flaps 22*b* and 22*d*, and the right arm unit 12 folds the outer flap 23*d*. However, the right arm unit 12 may hold down the inner flaps 22*b* and 22*d*, and the left arm unit 13 may fold the outer flap 23*d*.

As described above, the robot 1 holds down the inner flaps 22*b* and 22*d* by using the right arm unit 12 or the left arm unit 13, thereby making it possible to prevent the inner flaps 22*b* and 22*d* from rebounding without using the fixing device 30.

Figure 12A:
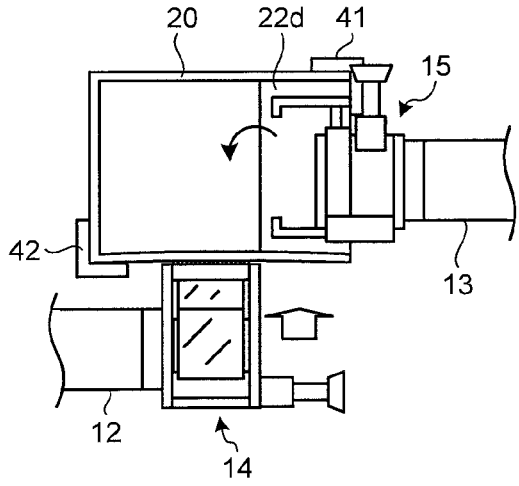
FIG. 12A to FIG. 12C are views for explaining another example of the operation of sealing the cardboard box.
Figure 12B:
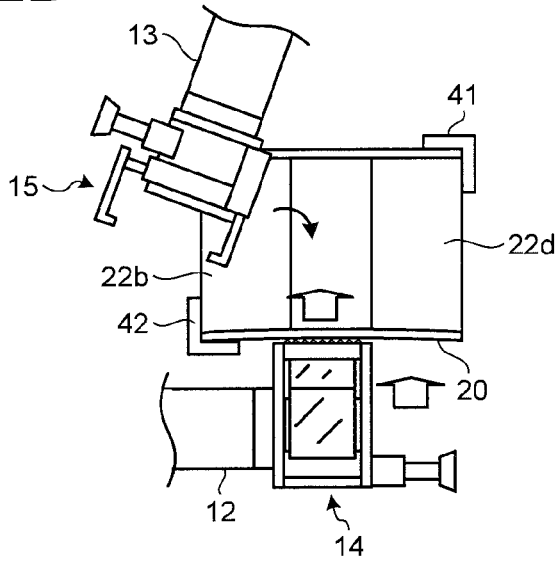
Figure 12C:
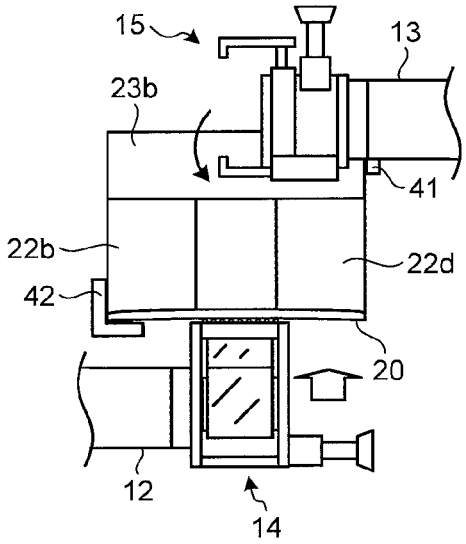

The method for preventing the inner flaps 22*b* and 22*d* from rebounding is not limited to the method illustrated in FIG. 11A to FIG. 11C. Another method for preventing the inner flaps 22*b* and 22*d* from rebounding will now be described with reference to FIG. 12A to FIG. 12C. FIG. 12A to FIG. 12C are views for explaining another example of the operation of sealing the cardboard box.

As illustrated in FIG. 12A, the robot 1 presses the side surface 21 of the cardboard box 20 to which the outer flaps 23 are provided by using the left arm unit 13, for example. As a result, the side surface 21 of the cardboard box 20 to which the outer flaps 23 are provided is bent inward in the same manner as in the case where the cardboard box 20 is fixed by using the fixing device 30.

Subsequently, as illustrated in FIG. 12B, the robot 1 folds the inner flaps 22*b* and 22*d* sequentially by using the left arm unit 13. At this time, the side surface 21 of the cardboard box 20 to which the outer flaps 23 are provided is bent inward in the cardboard box 20. Therefore, the inner flaps 22*b* and 22*d* folded toward the inside of the cardboard box 20 get stuck with the side surface 21 of the cardboard box 20. Thus, it is possible to prevent the cardboard box 20 from rebounding outward.

As illustrated in FIG. 12C, the robot 1 then folds the outer flap 23*b* halfway by using the left arm unit 13. As a result, the inner flaps 22*b* and 22*d* are held down by the outer flap 23*b*. After creating such a state, the robot 1 folds the outer flap 23*d* halfway by using the right arm unit 12.

Subsequently, the robot 1 applies the adhesive tape to both end portions of the outer flaps 23*b* and 23*d* by the same operation as the operation explained with reference to FIG. 8A to FIG. 8C. As a result, the cardboard box 20 is sealed.

In this example, the right arm unit 12 presses the side surface 21 of the cardboard box 20, and the left arm unit 13 folds the inner flaps 22*b* and 22*d*. However, the left arm unit 13 may press the side surface 21, and the right arm unit 12 may fold the inner flaps 22*b* and 22*d*.

As described above, the robot 1 may press the side surface 21 of the cardboard box 20 to which the outer flaps 23 are provided by using one arm unit of the right arm unit 12 and the left arm unit 13, and may fold the inner flaps 22*b* and 22*d* by using the other arm unit. With this configuration, it is possible to prevent the inner flaps 22*b* and 22*d* from rebounding without using the fixing device 30 in the same manner as in the operation explained with reference to FIG. 11A to FIG. 11C.

While the forming station 3 includes the fixing device 30 in the first embodiment, the forming station 3 does not necessarily include the fixing device 30. If the forming station 3 does not include the fixing device 30, the robot 1 needs only to perform the operation illustrated in FIG. 11A to FIG. 11C or FIG. 12A to FIG. 12C.

As described above, in the packing device 100 according to the first embodiment, the robot 1 sucks both side surfaces of the cardboard box 20 placed on the supply station 2 by using the suction unit 142 included in the right end effector 14 and the suction unit 153 included in the left end effector 15. The robot 1 then moves the cardboard box 20 to the forming station 3 while developing the cardboard box 20 by using the right arm unit 12 and the left arm unit 13. Therefore, the packing device 100 according to the first embodiment can improve the efficiency in the packing operations.

Furthermore, in the packing device 100 according to the first embodiment, one dual-arm robot includes two arm units of the right arm unit 12 and the left arm unit 13.

Specifically, in the packing device 100 according to the first embodiment, a dual-arm general-purpose robot in which various types of end effectors can be attached to arm tip portions is used to perform a series of packing operations. Therefore, with the packing device 100, even if the contents of the packing operations are changed, for example, it is possible to respond to the change in the contents of the operations flexibly by replacing the end effector without replacing the robot itself.

Furthermore, in the packing device 100 according to the first embodiment, the robot 1 performs the forming operation of the cardboard box 20, the operation of storing the products in the cardboard box 20 thus formed, the sealing operation of the cardboard box 20 in which the products are stored, and other operations. Therefore, the packing device 100 according to the first embodiment can perform the series of packing operations efficiently.

In the first embodiment, the operation of storing the products in the cardboard box 20 and the sealing operation of the cardboard box 20 are performed in the packing station 4. However, the storing operation and the sealing operation may be performed in the forming station 3. In such a case, the packing station 4 is not required.

The configuration of the packing device is not limited to the configuration explained in the first embodiment. For example, while the applying unit 141 is provided to the right end effector 14 fixedly in the first embodiment, the applying unit may be provided in a detachable manner. In the description below, another exemplary configuration of the packing device will be described.

Figure 13:
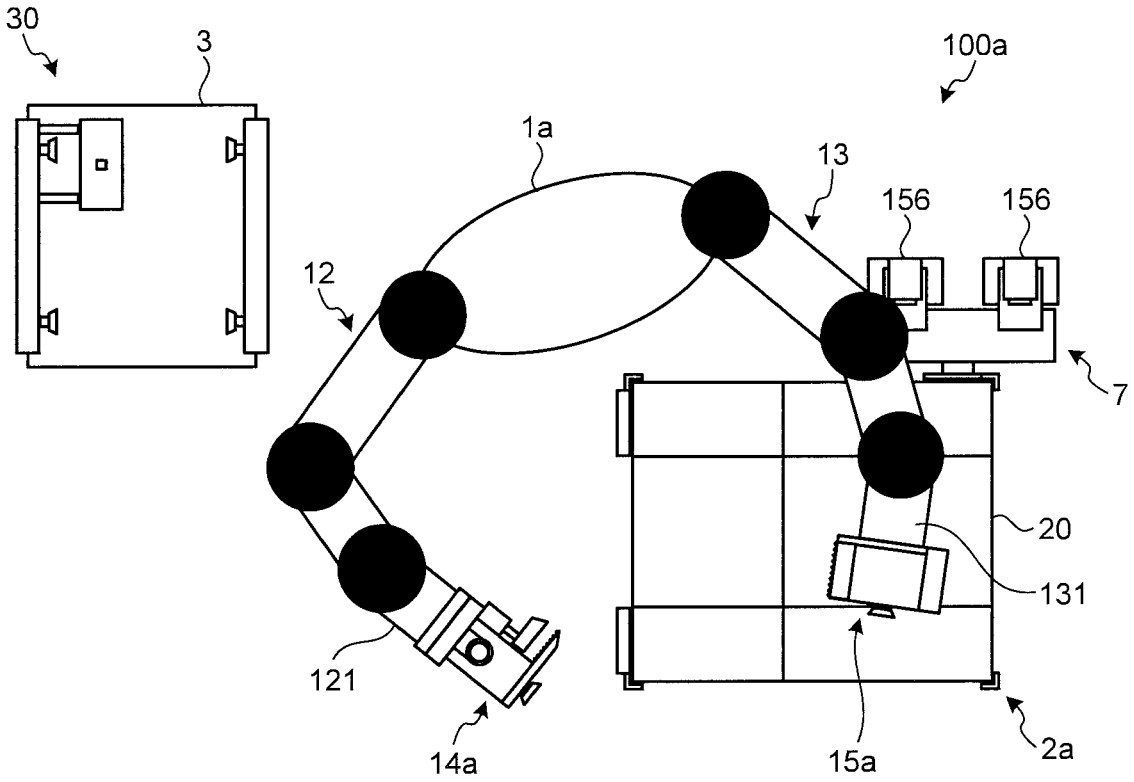
FIG. 13 is a schematic of an entire configuration of a packing device according to a second embodiment.

The entire configuration of a packing device according to a second embodiment will now be described with reference to FIG. 13. FIG. 13 is a schematic of the entire configuration of the packing device according to the second embodiment. In the description below, components similar to the components that have already been described are designated by reference numerals similar to those of the components that have already been described, and overlapped explanation thereof will be omitted.

As illustrated in FIG. 13, a packing device 100*a* according to the second embodiment includes a robot 1*a*, a supply station 2*a*, a forming station 3, and an applying unit holder 7. In the second embodiment, the supply station 2*a* and the forming station 3 are examples of the first work station and the second work station, respectively.

The robot 1*a* is a dual-arm robot that includes two arm units similarly to the robot 1 according to the first embodiment. The robot 1*a* includes a right end effector 14*a* and a left end effector 15*a* instead of the right end effector 14 and the left end effector 15 included in the robot 1 according to the first embodiment. The configurations of the end effectors 14*a* and 15*a* included in the robot 1*a* will be described later with reference to FIG. 14A and FIG. 14B. The configuration of the robot 1*a* except for the end effectors are the same as that of the robot 1 according to the first embodiment.

The supply station 2*a* is a work station on which a number of cardboard boxes 20 in a flat state are stacked. The configuration of the supply station 2*a* will be described later with reference to FIG. 15.

The applying unit holder 7 is a holder that holds an applying unit 156 provided to the left end effector 15*a* in a detachable manner, and is arranged on the supply station 2*a*. The configuration of the applying unit holder 7 will be described later with reference to FIG. 16.

The configurations of the end effectors 14*a* and 15*a* included in the robot 1*a* will now be described with reference to FIG. 14A and FIG. 14B.

The configuration of the right end effector 14*a* will now be described with reference to FIG. 14A. FIG. 14A is a schematic of the configuration of the right end effector 14*a* according to the second embodiment. In the second embodiment, the right end effector 14*a* is an example of the second end effector, and the right arm unit 12 is an example of the second arm unit.

Figure 14A:
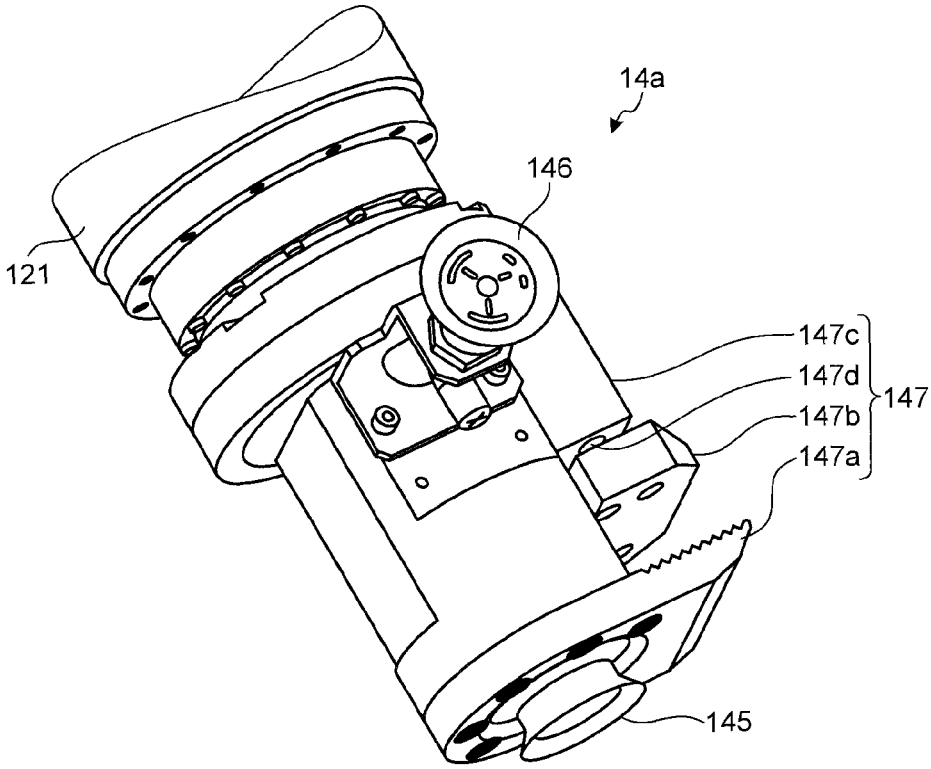
FIG. 14A is a schematic of a configuration of a right end effector according to the second embodiment.

As illustrated in FIG. 14A, the right end effector 14*a* is provided to the arm tip portion 121 of the right arm unit 12. The arm tip portion 121 of the right arm unit 12 holds the right end effector 14*a* in a rotatable manner about a rotation axis parallel to the extending direction of the arm.

The right end effector 14*a* includes two suction units 145 and 146 and a holding unit 147. The suction unit 145 is arranged along the rotation axis of the right arm unit 12. As will be explained later, the suction unit 145 is used for performing a turning operation of the cardboard box 20.

By contrast, the suction unit 146 is arranged in a direction perpendicular to the rotation axis of the right arm unit 12. As will be explained later, the suction unit 146 is used for performing the developing operation of the cardboard box 20. The suction units 145 and 146 suck an object by using suction generated by a suction device such as a vacuum pump similarly to the suction unit 142 according to the first embodiment.

As will be explained later, the holding unit 147 is used for taking out the cardboard box 20 in a flat state from the supply station 2*a*. Specifically, the holding unit 147 includes a first claw unit 147*a*, a second claw unit 147*b*, a driving unit 147*c*, and a shaft 147*d*.

The holding unit 147 moves the shaft 147*d* along the extending direction thereof by using the driving unit 147*c*. Thus, the second claw unit 147*b* connected to the shaft 147*d* moves toward the first claw unit 147*a*. As a result, an object positioned between the first claw unit 147*a* and the second claw unit 147*b* is sandwiched and supported by the first claw unit 147*a* and the second claw unit 147*b*. The holding unit 147 is an example of a second holding unit.

The configuration of the left end effector 15*a* will now be described with reference to FIG. 14B. FIG. 14B is a schematic of the configuration of the left end effector 15*a* according to the second embodiment. In the second embodiment, the left end effector 15*a* is an example of the first end effector, and the left arm unit 13 is an example of the first arm unit.

Figure 14B:
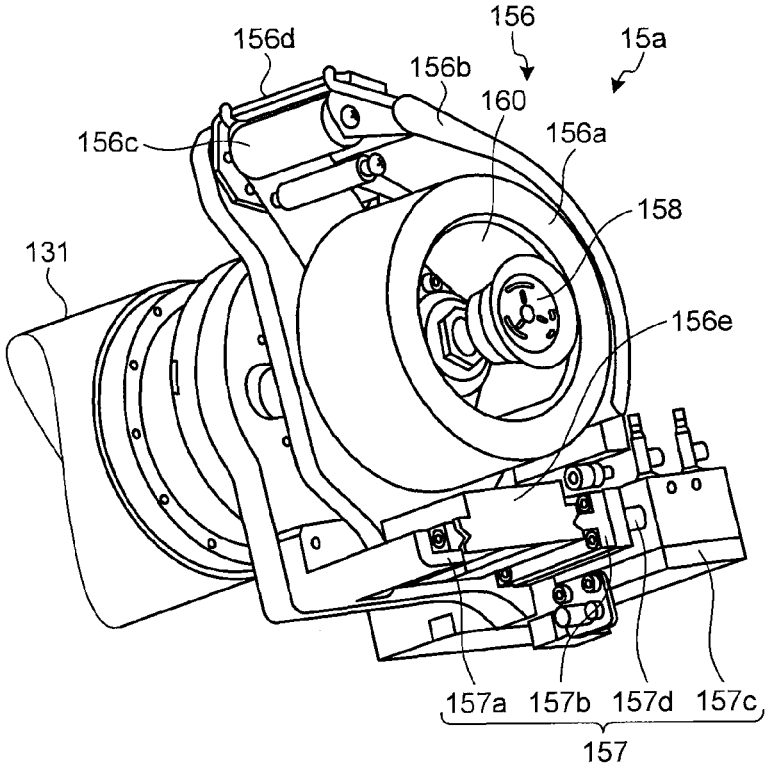
FIG. 14B is a schematic of a configuration of a left end effector according to the second embodiment.

As illustrated in FIG. 14B, the left end effector 15*a* is provided to the arm tip portion 131 of the left arm unit 13. The arm tip portion 131 of the left arm unit 13 holds the left end effector 15*a* in a rotatable manner about a rotation axis parallel to the extending direction of the arm.

The left end effector 15*a* includes the applying unit 156, a holding unit 157, and a suction unit 158. The applying unit 156 includes a tape main body 156*a*, a casing 156*b*, a roller 156*c*, a cutting unit 156*d*, and a held unit 156*e*.

The tape main body 156*a* is a member obtained by winding an adhesive tape in layers around a ring-shaped core 160. The tape main body 156*a* is attached to the casing 156*b* in a rotatable manner with the core 160 held by the casing 156*b*.

The casing 156*b* is a member covering the peripheral surface and the side surface of the tape main body 156*a*, for example. An opening (an opening 156*f* illustrated in FIG. 16) having a shape nearly the same as that of the core 160 of the tape main body 156*a* is formed in the casing 156*b*.

The roller 156*c* is a cylindrical member attached to the casing 156*b* in a rotatable manner. The roller 156*c* presses the adhesive tape extracted from the tape main body 156*a* against the cardboard box 20 to which the adhesive tape is to be applied. The cutting unit 156*d* is a cutter that is provided to the casing 156*b*, and that cuts the adhesive tape extracted from the tape main body 156*a*.

The held unit 156*e* is a member held by the holding unit 157. The holding unit 157 holds the held unit 156*e*, whereby the applying unit 156 is attached to the left end effector 15*a*.

The holding unit 157 is a mechanical unit that holds the held unit 156*e*. Specifically, the holding unit 157 includes a first claw unit 157*a*, a second claw unit 157*b*, a driving unit 157*c*, and a shaft 157*d*.

The holding unit 157 moves the shaft 157*d* along the extending direction thereof by using the driving unit 157*c*. Thus, the second claw unit 157*b* connected to the shaft 157*d* moves toward the first claw unit 157*a*. As a result, the held unit 156*e* positioned between the first claw unit 157*a* and the second claw unit 157*b* is sandwiched and supported by the first claw unit 157*a* and the second claw unit 157*b*.

As described above, in the packing device 100*a* according to the second embodiment, the applying unit 156 is attached in a detachable manner to the left end effector 15*a* serving as the first end effector. Therefore, the packing device 100*a* according to the second embodiment can facilitate a replacing operation of the tape main body 156*a*, for example. The holding unit 157 is an example of a first holding unit.

The suction unit 158 is arranged along the rotation axis of the left arm unit 13. The suction unit 158 is used for performing the operation of turning the cardboard box 20 whose bottom surface is formed and other operations similarly to the suction unit 145 included in the right end effector 14*a*.

The suction unit 158 is inserted into the core 160 of the tape main body 156*a* through the opening formed in the casing 156*b* of the applying unit 156. Arranging the suction unit 158 so as to be inserted into the core 160 of the tape main body 156*a* in this manner makes it possible to prevent the left end effector 15*a* from increasing in size.

Figure 15:
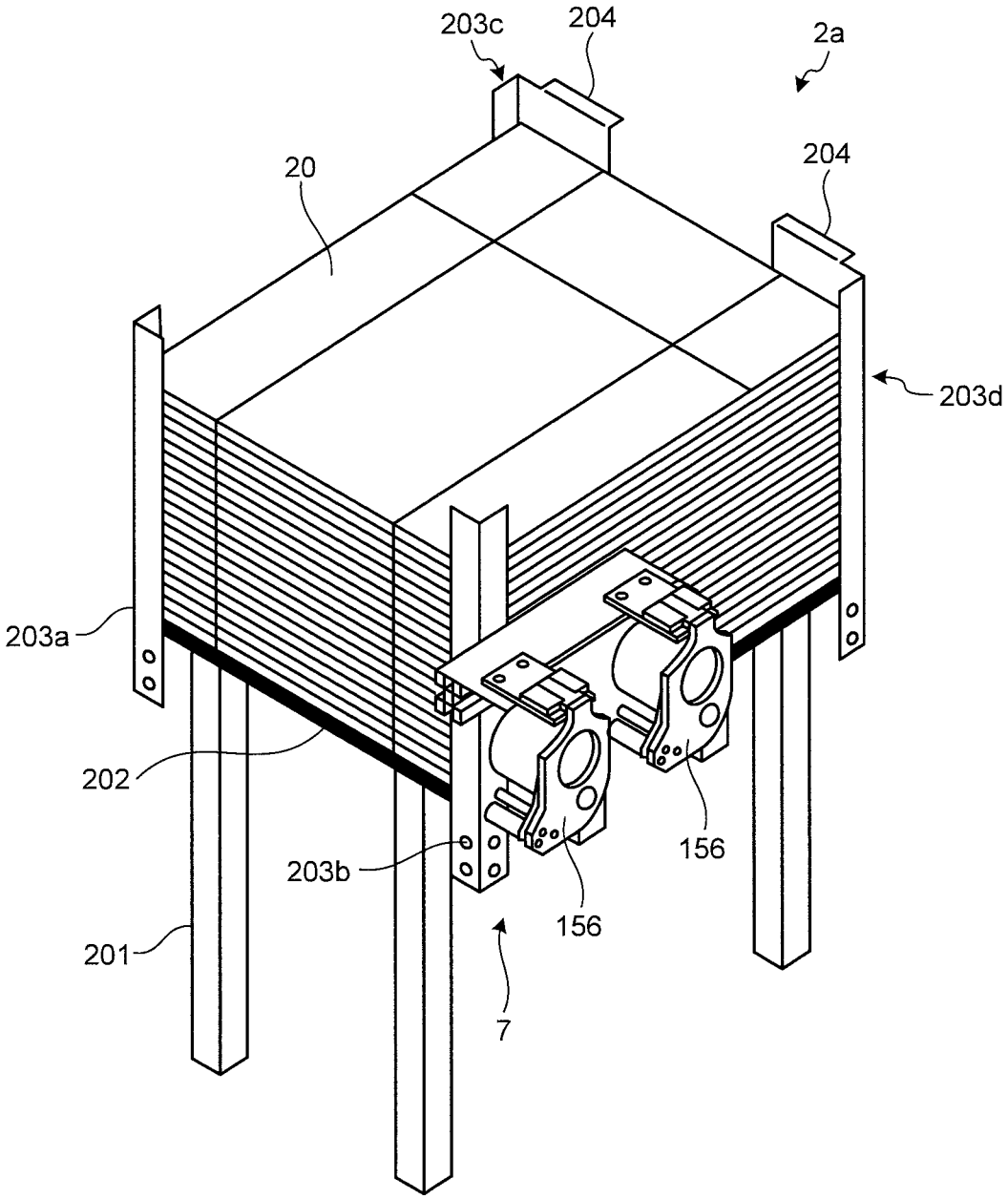
FIG. 15 is a schematic of a configuration of a supply station according to the second embodiment.

The configuration of the supply station 2*a* according to the second embodiment will now be described with reference to FIG. 15. FIG. 15 is a schematic of the configuration of the supply station 2*a* according to the second embodiment.

As illustrated in FIG. 15, the supply station 2*a* includes a leg 201, a base 202, and frames 203*a* to 203*d*. The leg 201 is a member for arranging the base 202 in a predetermined height. The case 202 is a plate-like member having a shape nearly the same as that of the cardboard box 20 in a flat state, and is supported by the leg 201.

The frames 203*a* to 203*d* are members provided to four corners of the base 202 so as to maintain the state of the cardboard boxes 20 being stacked. The frames 203*a* to 203*d* are arranged in a standing manner along the vertical direction, and come into contact with four corners of the cardboard boxes 20 placed on the base 202.

A flange 204 extending in the horizontal direction is formed in two of the frames 203*c* and 203*d* arranged on the forming station 3 side among the frames 203*a* to 203*d*. The flange 204 is used as a temporary place on which the cardboard box 20 taken out from the supply station 2*a* is placed temporarily, which will be described later with reference to FIG. 18A to FIG. 18C.

Figure 16:
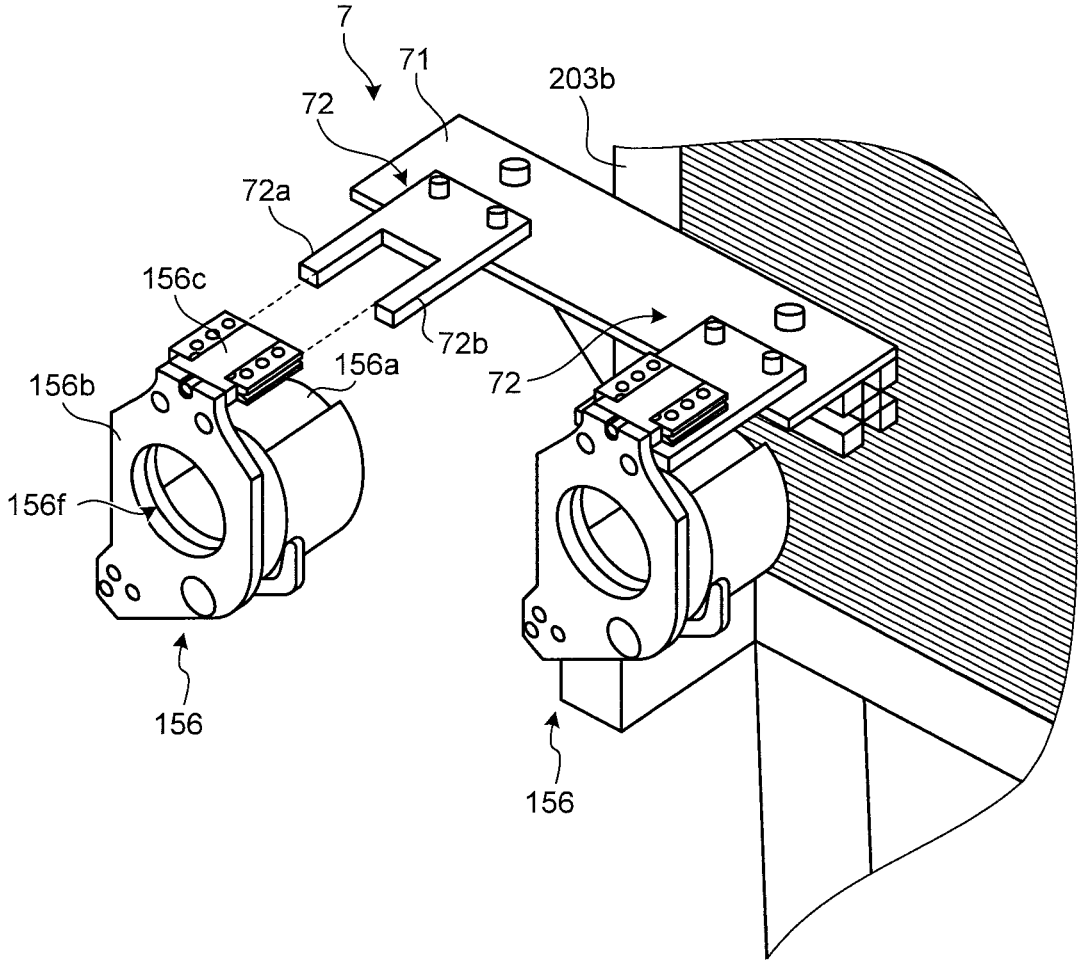
FIG. 16 is a schematic of a configuration of an applying unit holder.

Furthermore, the applying unit holder 7 is attached to the frame 203*b* arranged at a position closer to the left arm unit 13 of the robot 1*a* among the frames 203*a* to 203*d*. The configuration of the applying unit holder 7 will now be described with reference to FIG. 16. FIG. 16 is a schematic of the configuration of the applying unit holder 7.

As illustrated in FIG. 16, the applying unit holder 7 includes a base unit 71 fixed to the frame 203*b* of the supply station 2*a* and a supporting unit 72 fixed to the base unit 71. In the supporting unit 72, two claw portions 72*a* and 72*b* protruding in the horizontal direction are provided with a predetermined space interposed therebetween.

The two claw portions 72*a* and 72*b* supports the lower portion of the held unit 156*e*, whereby the applying unit 156 is supported by the supporting unit 72.

To attach the applying unit 156 to the left end effector 15*a*, the robot 1*a* moves the left end effector 15*a* to place the held unit 156*e* of the applying unit 156 between the first claw unit 157*a* and the second claw unit 157*b* of the holding unit 157. At this time, the suction unit 158 of the left end effector 15*a* is inserted into the core 160 of the tape main body 156*a* through the opening 156*f* formed in the casing 156*b* of the applying unit 156.

The robot 1*a* then holds the held unit 156*e* by using the holding unit 157. As a result, the applying unit 156 is attached to the left end effector 15*a*.

As described above, in the packing device 100*a* according to the second embodiment, the applying unit holder 7 is provided to the supply station 2*a*. Therefore, by setting a spare applying unit 156 in advance on the supporting unit 72 of the applying unit holder 7, it is possible to facilitate the replacing operation of the applying unit 156.

While the applying unit holder 7 includes two supporting units 72 in this example, the number of supporting units 72 may be three or more, or one. Furthermore, while the applying unit holder 7 is fixed to the supply station 2*a* in this example, the applying unit holder 7 may be provided separately from the supply station 2*a*.

Figure 17A:
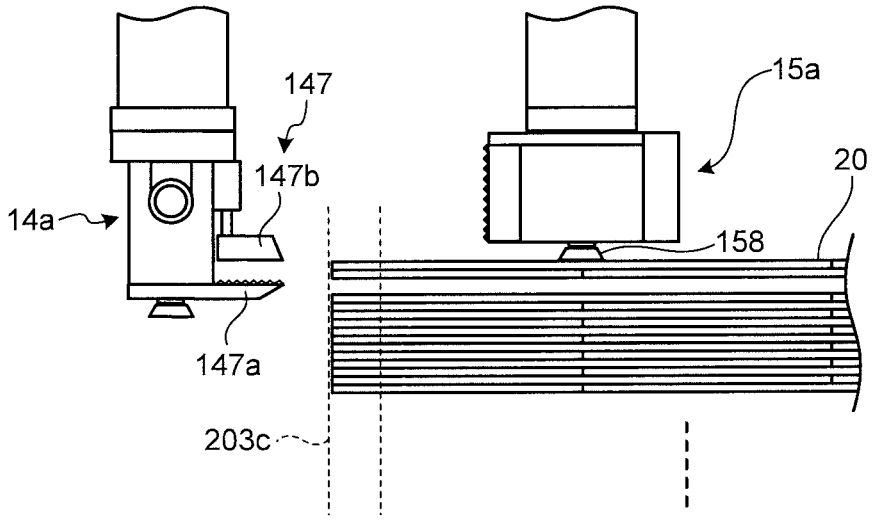
FIG. 17A and FIG. 17B are views for explaining an operation of taking out a cardboard box from the supply station.
Figure 17B:
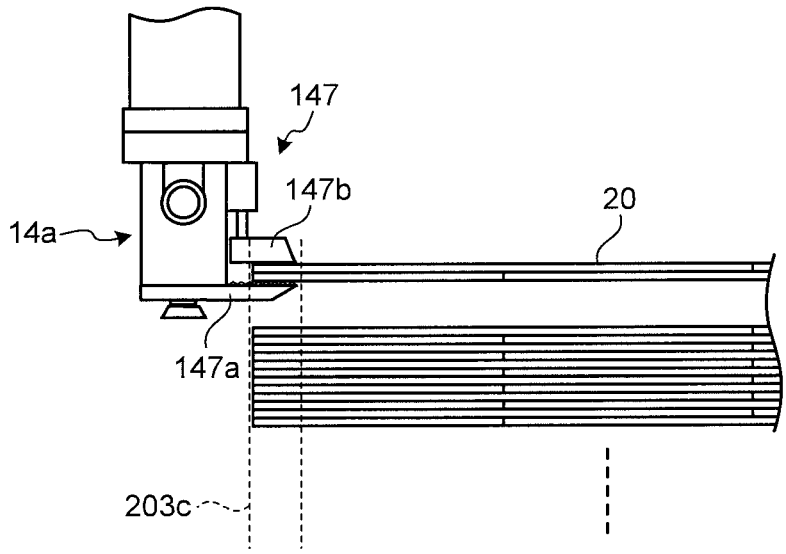

An operation of taking out the cardboard box 20 from the supply station 2*a* will now be described with reference to FIG. 17A and FIG. 17B. FIG. 17A and FIG. 17B are views for explaining the operation of taking out the cardboard box 20 from the supply station 2*a*.

As illustrated in FIG. 17A, in the robot 1*a*, the left arm unit 13 slightly lifts the cardboard box 20 positioned uppermost among the cardboard boxes 20 stacked on the supply station 2*a* while sucking the cardboard box 20 by using the suction unit 158 of the left end effector 15*a*. As a result, a space is formed into which the first claw unit 147*a* of the holding unit 147 included in the right end effector 14*a* is to be inserted between the cardboard box 20 positioned uppermost and another cardboard box 20 positioned just under the cardboard box 20.

Subsequently, in the robot 1*a*, the right arm unit 12 holds both side surfaces of the cardboard box 20 lifted by the left arm unit 13 by using the holding unit 147 as illustrated in FIG. 17B. In the robot 1*a*, the right arm unit 12 then moves the cardboard box 20 held by the holding unit 147 from the supply station 2*a*.

As described above, in the packing device 100*a* according to the second embodiment, the robot 1*a* can directly takes out the cardboard box 20 from the supply station 2*a* on which a number of cardboard boxes 20 in a flat state are stacked. Therefore, it is possible to improve the work efficiency.

Furthermore, in the packing device 100*a* according to the second embodiment, after lifting the cardboard box 20 slightly by using the suction unit 158 of the left end effector 15*a*, the robot 1*a* holds the cardboard box 20 thus lifted by using the holding unit 147 of the right end effector 14*a*. Therefore, the robot 1*a* can hold one of a number of cardboard boxes 20 thus stacked reliably.

In this example, the cardboard box 20 is taken out from the supply station 2*a* by using the holding unit 147 and the suction unit 158. However, the robot 1*a* may takes out the cardboard box 20 from the supply station 2*a* by using the holding unit 147 alone.

Figure 18A:
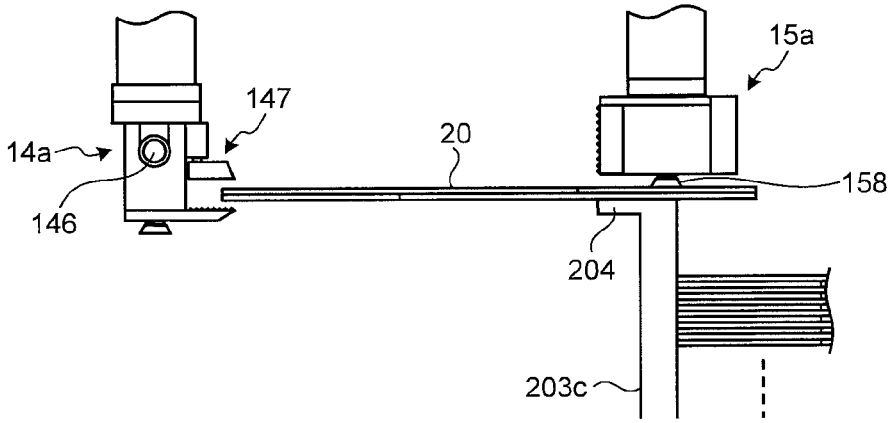
FIG. 18A to FIG. 18C are views for explaining a developing operation of the cardboard box.
Figure 18B:
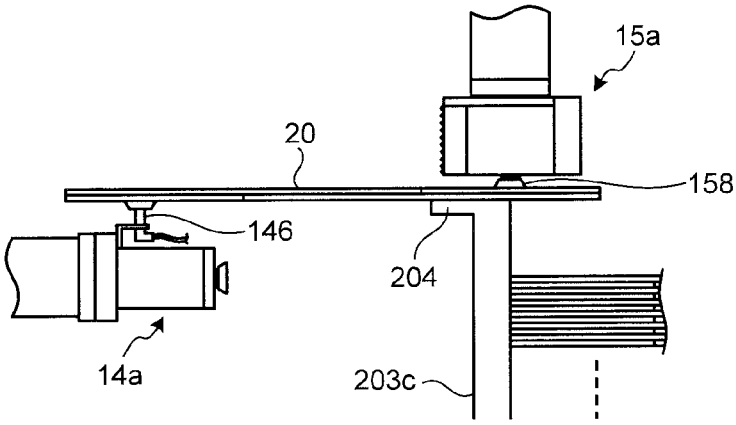
Figure 18C:
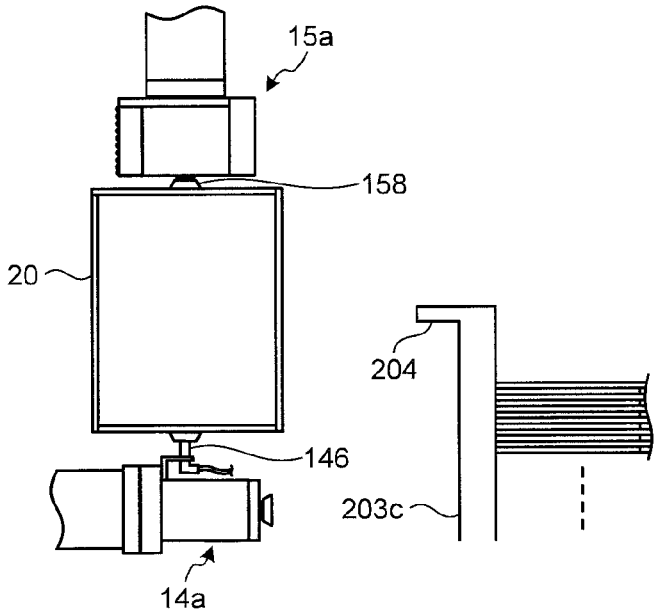

The developing operation of the cardboard box 20 taken out from the supply station 2*a* will now be described with reference to FIG. 18A to FIG. 18C. FIG. 18A to FIG. 18C are views for explaining the developing operation of the cardboard box 20.

After taking out the cardboard box 20 from the supply station 2*a*, the robot 1*a* temporarily places the cardboard box 20 thus taken out on the flange 204 formed in the upper portion of the frames 203*c* and 203*d*. Subsequently, the robot 1*a* switches the operational state from the state in which the holding unit 147 of the right end effector 14*a* holds the cardboard box 20 to the state in which the suction unit 146 of the right end effector 14*a* sucks the cardboard box 20. The robot 1*a* then performs the same operation as the developing operation described in the first embodiment to develop the cardboard box 20 in a flat state.

As illustrated in FIG. 18A, after placing the cardboard box 20 taken out from the supply station 2*a* on the flange 204, the robot 1*a* holds down the upper surface of the cardboard box 20 by using the suction unit 158 of the left end effector 15*a* such that the cardboard box 20 thus placed does not fall. Subsequently, in the robot 1*a*, the right arm unit 12 releases the holding unit 147 from the cardboard box 20.

Subsequently, in the robot 1*a*, the right arm unit 12 sucks the lower surface of the cardboard box 20 by using the suction unit 146 of the right end effector 14*a* as illustrated in FIG. 18B. Furthermore, in the robot 1*a*, the left arm unit 13 sucks the upper surface of the cardboard box 20 by using the suction unit 158 of the left end effector 15*a*.

Similarly to the robot 1 according to the first embodiment, the robot 1*a* sucks the side surfaces positioned opposite to each other when the cardboard box 20 is developed three-dimensionally among the side surfaces of the cardboard box 20 in a flat state by using the suction unit 146 and the suction unit 158.

Subsequently, as illustrated in FIG. 18C, the robot 1*a* drives the right arm unit 12 and the left arm unit 13 while the suction units 146 and 158 are sucking both surfaces of the cardboard box 20, thereby developing the cardboard box 20 in a flat state three-dimensionally. Furthermore, the robot 1*a* moves the cardboard box 20 thus developed three-dimensionally to the forming station 3.

As described above, in the packing device 100*a* according to the second embodiment, the right arm unit 12 takes out the cardboard box 20 from the supply station 2*a* by using the holding unit 147, and temporarily places the cardboard box 20 on the flange 204 of the frames 203*c* and 203*d*. Subsequently, the right arm unit 12 and the left arm unit 13 perform the operation of developing the cardboard box 20 and the operation of moving the cardboard box 20 to the forming station 3 while sucking both side surfaces of the cardboard box 20 placed on the flange 204 by using the suction units 146 and 158, respectively.

In other words, in the packing device 100*a* according to the second embodiment, the flange 204 formed in the frames 203*c* and 203*d* of the supply station 2*a* is used as the temporary place for the cardboard box 20 taken out from the supply station 2*a*. Therefore, it is possible to save space for the packing device 100*a*.

Furthermore, in the packing device 100*a* according to the second embodiment, the left arm unit 13 holds down the upper surface of the cardboard box 20 placed on the flange 204 by using the suction unit 158 included in the left end effector 15*a*.

As a result, the cardboard box 20 is held by the flange 204 and the left end effector 15*a*. Therefore, it is possible to prevent the cardboard box 20 from falling reliably without making the size of the flange 204 nearly equal to that of the cardboard box 20. Furthermore, because the flange 204 can be made small, it is possible to downsize the packing device 100*a*.

In the packing device 100*a*, a flange having a size nearly equal to that of the cardboard box 20 may be formed in the frames 203*c* and 203*d*. With such a configuration, there is no need to hold down the upper surface of the cardboard box 20 by the left arm unit 13.

The forming operation of the cardboard box 20 performed in the forming station 3 will now be described. In the forming station 3, the operation of fixing the cardboard box 20 by using the fixing device 30, the operation of folding the inner flaps 22 and the outer flaps 23, and the operation of jointing both ends of the outer flaps 23 with the adhesive tape are performed. Among these operations, the operation of fixing the cardboard box 20 by using the fixing device 30 and the operation of folding the inner flaps 22 and the outer flaps 23 are the same as those in the first embodiment. Therefore, the operation of jointing both ends of the outer flaps 23 with the adhesive tape will now be described with reference to FIG. 19A to FIG. 19E.

FIG. 19A to FIG. 19E are views for explaining the operation of applying the adhesive tape. To facilitate understanding, illustration of the fixing device 30 is omitted in FIG. 19A to FIG. 19E.

Figure 19A:
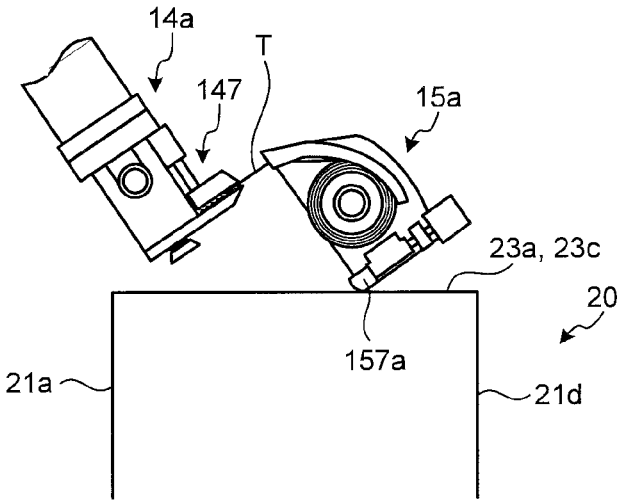
FIG. 19A to FIG. 19E are views for explaining an operation of applying an adhesive tape.

As illustrated in FIG. 19A, in the cardboard box 20, the outer flaps 23*a* and 23*c* are folded. To prevent the outer flaps 23*a* and 23*c* thus folded from rebounding, the robot 1*a* holds down the outer flaps 23*a* and 23*c* by using the first claw unit 157*a* included in the holding unit 157 of the left end effector 15*a*. In the first claw unit 157*a*, the portion coming into contact with the outer flaps 23*a* and 23*c* is formed into a curved shape so as not to scratch the outer flaps 23*a* and 23*c*.

While holding down the outer flaps 23*a* and 23*c* by using the first claw unit 157*a*, the robot 1*a* holds and extracts an adhesive tape T of the applying unit 156 included in the left end effector 15*a* by using the holding unit 147 of the right end effector 14*a*.

Figure 19B:
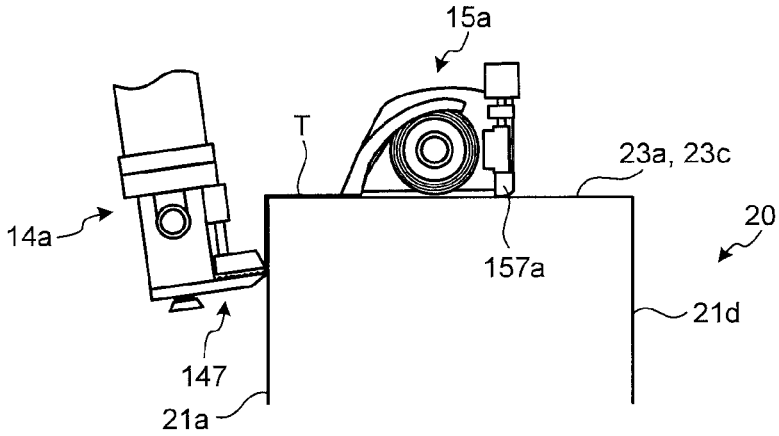

Subsequently, as illustrated in FIG. 19B, the robot 1*a* applies the adhesive tape T to the cardboard box 20 by using the holding unit 147 of the right end effector 14*a* while moving the left end effector 15*a* toward the cardboard box 20 pivotally about the first claw unit 157*a*. The robot 1*a* applies the adhesive tape T held by the holding unit 147 to the position illustrated in FIG. 19B, that is, to the side surface 21*a* of the cardboard box 20.

As described above, in the packing device 100*a* according to the second embodiment, the right arm unit 12 of the robot 1*a* holds and extracts the adhesive tape T by using the holding unit 147, and applies the adhesive tape T thus extracted to the cardboard box 20. With this configuration, the robot 1*a* can apply the adhesive tape T to the cardboard box 20 more neatly. The robot 1*a*, for example, can prevent the adhesive tape T applied to the side surface 21*a* of the cardboard box 20 from riding up from the cardboard box 20.

Figure 19C:
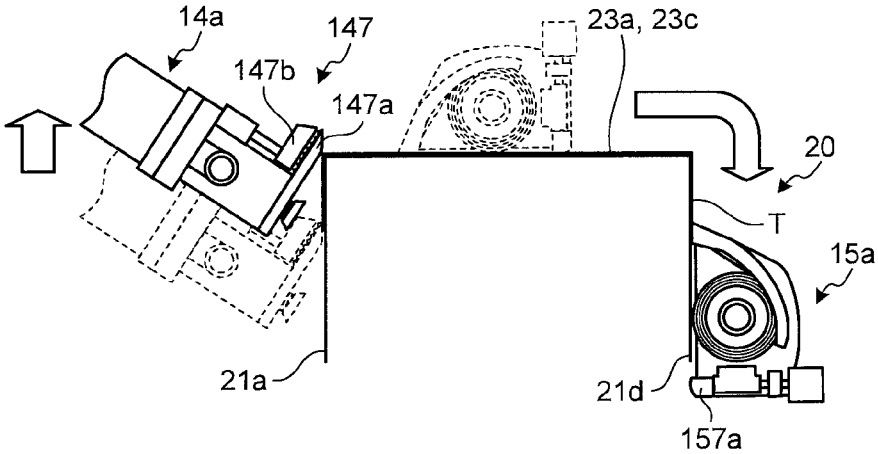

As illustrated in FIG. 19C, in the robot 1*a*, the left arm unit 13 applies the adhesive tape T from the position illustrated in FIG. 19B to the side surface 21*d* via the outer flaps 23*a* and 23*c*. Furthermore, in the robot 1*a*, the right arm unit 12 presses the adhesive tape T applied to the side surface 21*a* of the cardboard box 20 by using the first claw unit 147*a* of the holding unit 147.

Figure 19D:
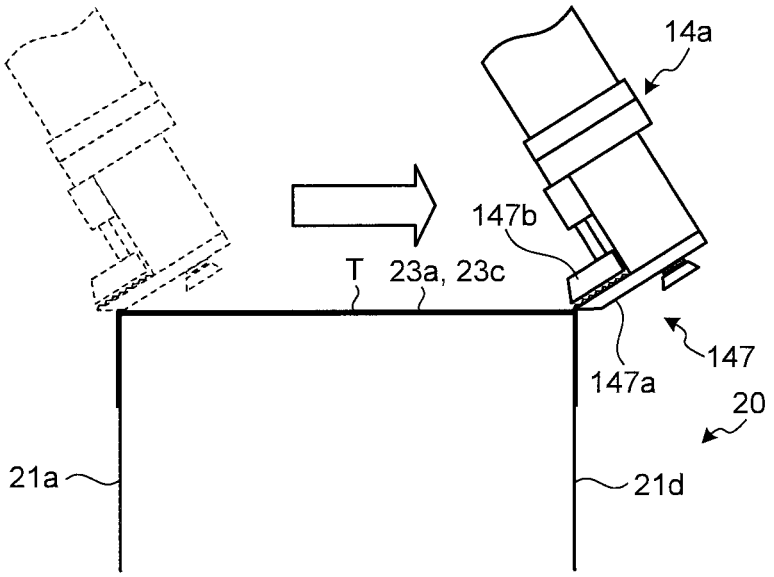
Figure 19E:
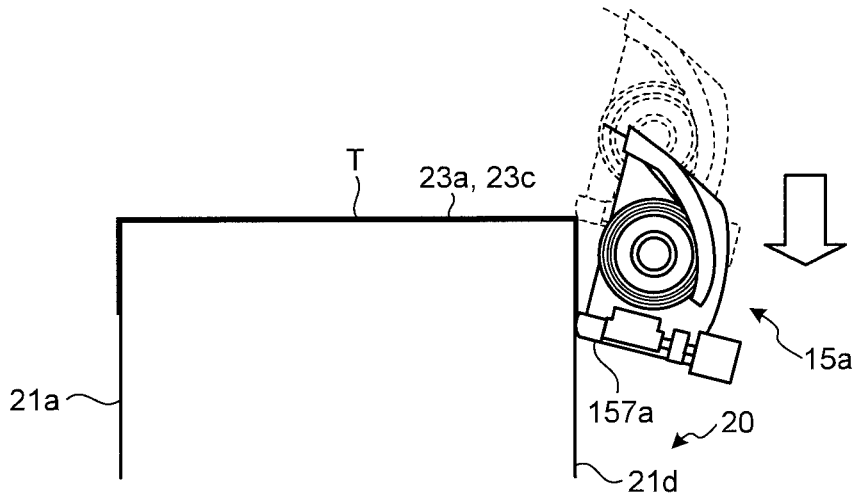

Subsequently, in the robot 1*a*, the right arm unit 12 presses the adhesive tape T applied to the outer flaps 23*a* and 23*c* by using the first claw unit 147*a* of the holding unit 147 as illustrated in FIG. 19D. Furthermore, in the robot 1*a*, the left arm unit 13 presses the adhesive tape T applied to the side surface 21*d* of the cardboard box 20 by using the first claw unit 157*a* of the left end effector 15*a* as illustrated in FIG. 19E.

By pressing the adhesive tape T applied to the cardboard box 20 using the right end effector 14*a* and the left end effector 15*a* in this manner, it is possible to apply the adhesive tape T to the cardboard box 20 securely.

On the cardboard box 20, the adhesive tape T is applied to the outer flaps 23*a* and 23*c*, whereby the bottom surface is formed by the outer flaps 23*a* and 23*c*. At this time, the cardboard box 20 is positioned with the bottom surface formed by the outer flaps 23*a* and 23*c* facing upward. Therefore, the robot 1*a* performs an operation of turning the cardboard box 20 such that the opening of the cardboard box 20 faces upward before performing the operation of storing products in the cardboard box 20.

Figure 20A:
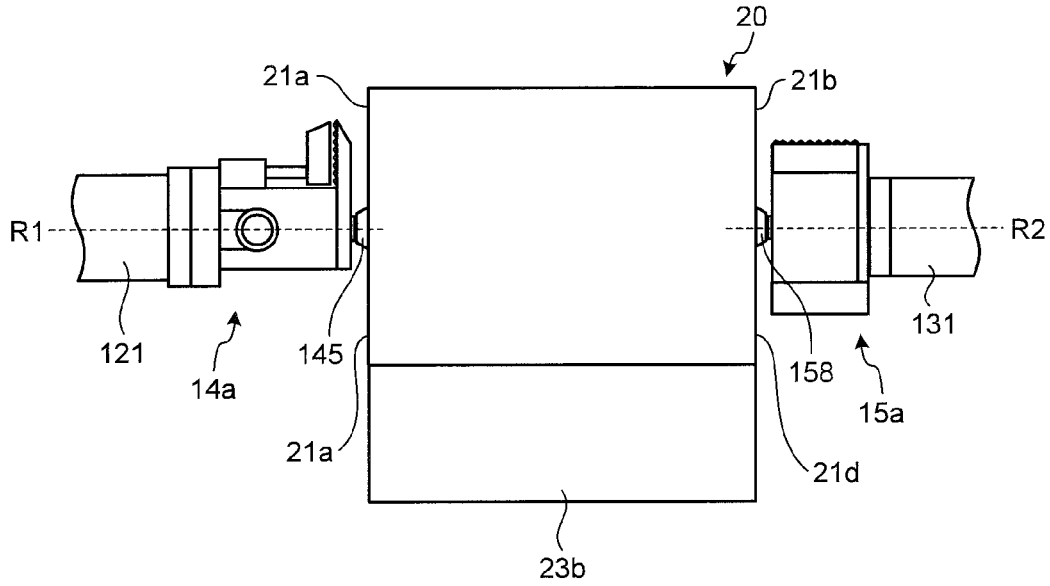
FIG. 20A and FIG. 20B are views for explaining an operation of turning the cardboard box.
Figure 20B:
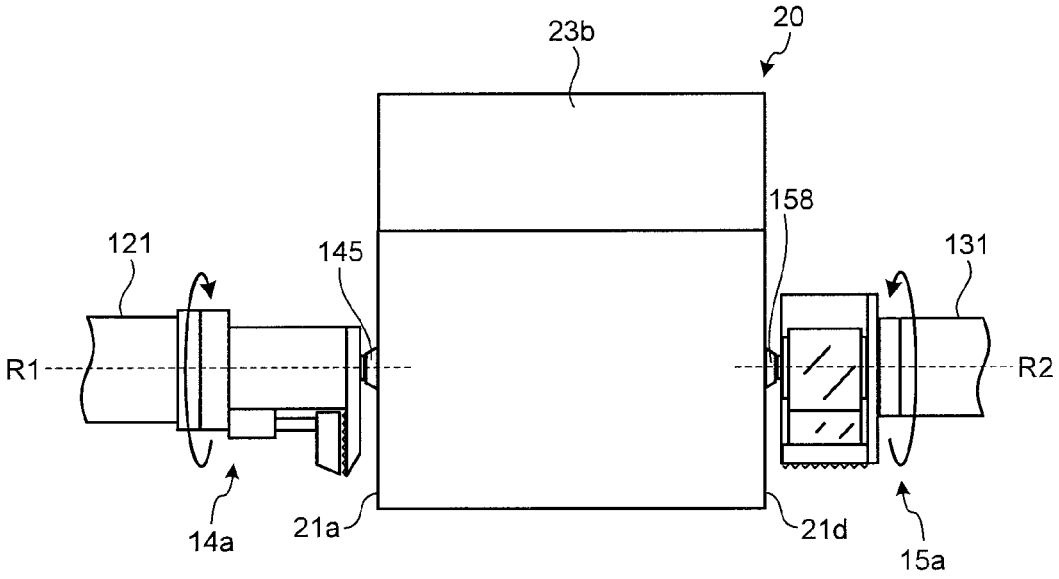

The operation of turning the cardboard box 20 will now be described with reference to FIG. 20A and FIG. 20B. FIG. 20A and FIG. 20B are views for explaining the operation of turning the cardboard box 20.

As illustrated in FIG. 20A, in the robot 1*a*, the right arm unit 12 sucks the side surface 21*a* of the cardboard box 20 by using the suction unit 145 of the right end effector 14*a*. Furthermore, in the robot 1*a*, the left arm unit 13 sucks the side surface 21*d* positioned opposite to the side surface 21*a* by using the suction unit 158 of the left end effector 15*a*.

The suction unit 145 of the right end effector 14*a* is arranged along a rotation axis R1 of the arm tip portion 121. Furthermore, the suction unit 158 of the left end effector 15*a* is arranged along a rotation axis R2 of the arm tip portion 131.

Subsequently, after removing the cardboard box 20 from the fixing device 30 of the forming station 3, the robot 1*a* rotates the arm tip portion 121 and the arm tip portion 131 about the rotation axis R1 and the rotation axis R2, respectively, by 180 degrees as illustrated in FIG. 20B. As a result, the cardboard box 20 is positioned with the opening facing upward.

As described above, in the packing device 100*a* according to the second embodiment, the suction unit 145 of the right end effector 14*a* is arranged along the rotation axis R1 of the arm tip portion 121, and the suction unit 158 of the left end effector 15*a* is arranged along the rotation axis R2 of the arm tip portion 131. Furthermore, in the packing device 100*a* according to the second embodiment, after sucking the side surfaces positioned opposite to each other in the cardboard box 20 whose bottom surface is formed by using the suction units 145 and 158, the right arm unit 12 and the left arm unit 13 rotate the arm tip portions 121 and 131, respectively.

In other words, in the packing device 100*a* according to the second embodiment, the suction unit 145 is arranged along the rotation axis R1 of the arm tip portion 121, and the suction unit 158 is arranged along the rotation axis R2 of the arm tip portion 131. With this configuration, only by rotating the arm tip portions 121 and 131, it is possible to turn the cardboard box 20. Therefore, the packing device 100*a* according to the second embodiment can facilitate the operation of turning the cardboard box 20.

After performing the operation of turning the cardboard box 20 illustrated in FIG. 20A and FIG. 20B, the robot 1*a* refixes the cardboard box 20 by using the fixing device 30, and performs the operation of storing the products in the cardboard box 20.

Figure 21:
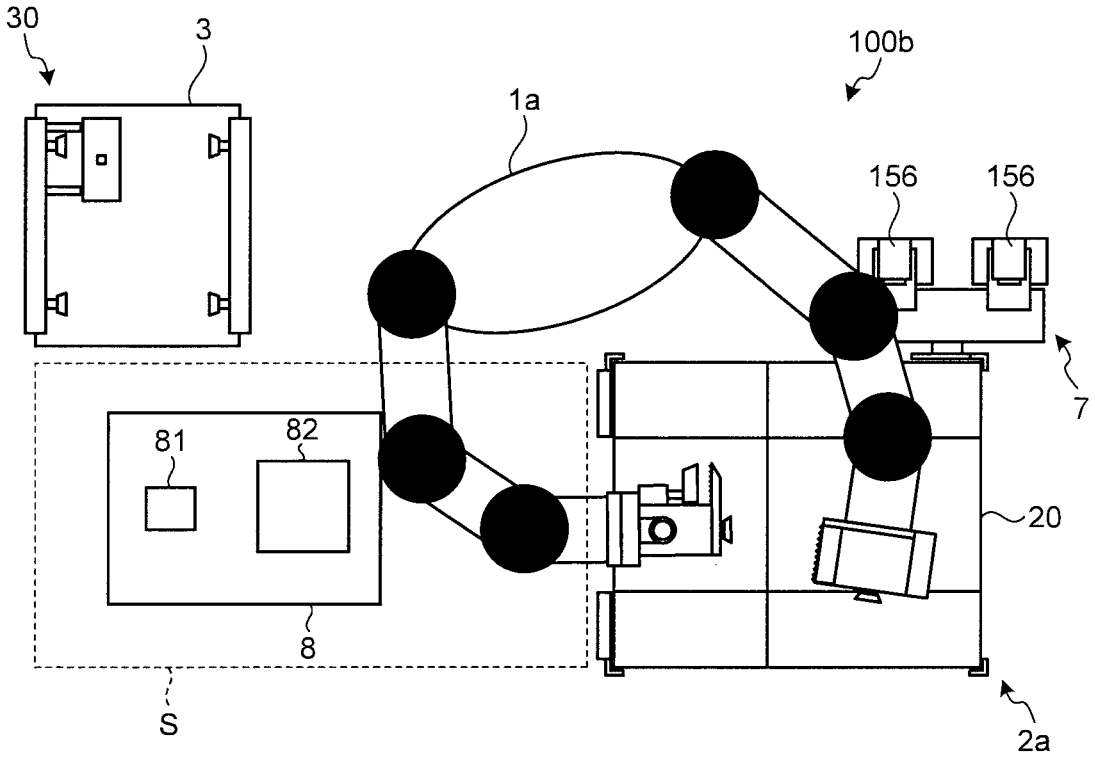
FIG. 21 is a schematic of another exemplary configuration of the packing device according to the second embodiment.

The packing device 100*a* may further include a stand on which the products to be stored in the cardboard box 20 are placed, which is not illustrated in FIG. 13. The exemplary configuration of the packing device further including the stand on which the products are placed will now be described with reference to FIG. 21. FIG. 21 is a schematic of another exemplary configuration of the packing device according to the second embodiment.

As illustrated in FIG. 21, a packing device 100*b* further includes a stand 8 in addition to the components included in the packing device 100*a* according to the second embodiment. The stand 8 is a stand on which various types of products to be stored in the cardboard box 20 are placed. A workpiece 81 and a workpiece 82 are placed on the stand 8, for example.

As illustrated in FIG. 13, in the packing device 100*a* according to the second embodiment, the supply station 2*a* is arranged ahead of the robot 1*a* on the left, and the forming station 3 is arranged on the right side of the robot 1*a*. As a result, in the packing device 100*a* according to the second embodiment, a vacant space S is present ahead of the robot 1*a* on the right.

Therefore, in the packing device 100*b* illustrated in FIG. 21, the stand 8 is arranged in the vacant space S. With this configuration, the vacant space S can be used effectively. Furthermore, it is possible to save space for the arrangement space of the packing device 100*b*.

After storing the workpieces 81 and 82 in the cardboard box 20, the robot 1*a* performs the same operation as the operation explained with reference to FIG. 19A to FIG. 19E to seal the cardboard box 20. The robot 1*a* then removes the cardboard box 20 thus sealed from the fixing device 30, and moves the cardboard box 20 to a discharge place, which is not illustrated. The discharge place is a belt conveyer arranged behind the robot 1*a*, for example.

As described above, in the second embodiment, the applying unit 156 is attached to the left end effector 15*a* in a detachable manner. Therefore, it is possible to facilitate the replacing operation of the tape main body 156*a*.

Furthermore, in the second embodiment, the holding unit 147 is provided to the right end effector 14*a*, and the operation of taking out the cardboard box 20 from the supply station 2*a* is performed by using the holding unit 147. With this configuration, the robot 1*a* can directly take out the cardboard box 20 from the supply station 2*a* on which a number of cardboard boxes 20 in a flat state are stacked. Therefore, it is possible to improve the work efficiency.

Moreover, in the second embodiment, the robot 1*a* performs the operation of applying the adhesive tape T by using the holding unit 147 included in the right end effector 14*a*. With this configuration, the robot 1*a* can apply the adhesive tape T to the cardboard box 20 more neatly.

In the second embodiment, an example has been explained in which the operation of storing the products in the cardboard box 20 and the sealing operation of the cardboard box 20 are performed in the forming station 3. However, the packing devices 100*a* and 100*b* may include the packing station 4 included in the packing device 100 according to the first embodiment, for example, and perform the storing operation and the sealing operation in the packing station 4.

In the second embodiment, an example has been explained in which the right end effector 14*a* includes two suction units 145 and 146. However, the right end effector 14*a* may include one of the suction units 145 and 146 alone.

In the second embodiment, for example, an example has been explained in which the bottom surface of the cardboard box 20 placed on the flange 204 of the supply station 2*a* is sucked by using the suction unit 146. However, if the suction unit 145 reaches the bottom surface of the cardboard box 20, the right end effector 14*a* may include the suction unit 145 alone.

In the embodiments described above, one dual-arm robot includes two arm units. However, the packing device may perform the packing operations described above by using two single-arm robots each including one arm unit.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

With regard to the embodiments described above, the following aspects are further disclosed.

Note 1. A packing device comprising:

a first work station on which a packing material in a flat state is placed;

a first end effector and a second end effector including a suction unit that sucks an object;

a first arm unit that includes the first end effector and a second arm unit that includes the second end effector; and a second work station on which the packing material developed three-dimensionally is placed, wherein an operation of developing the packing material and an operation of moving the packing material to the second work station are performed by using the first arm unit and the second arm unit while both side surfaces of the packing material placed on the first work station are being sucked by using the suction unit included in the first end effector and the suction unit included in the second end effector.

Note 2. The packing device according to Note 1, wherein after the packing material is moved to the second work station, flaps provided to side surfaces of the packing material are folded toward an inside of the packing material by using the first arm unit and the second arm unit.

Note 3. The packing device according to Note 2, wherein the second work station includes a pressing unit that presses a side surface of the packing material to which an outer flap serving as a flap that forms a bottom surface of the packing material among the flaps is provided from an outside of the packing material, and the first arm unit and the second arm unit fold a pair of inner flaps serving as flaps positioned on an inner side of the packing material than the outer flap among the flaps toward the inside of the packing material pressed by the pressing unit.

Note 4. The packing device according to Note 3, wherein the first end effector includes an applying unit that applies a predetermined adhesive member, and the first arm unit applies the predetermined adhesive member to both end portions of a pair of such outer flaps folded such that the end portions come into contact with each other by using the applying unit.

Note 5. The packing device according to Note 4, wherein the applying unit is attached to the first end effector in a detachable manner.

Note 6. The packing device according to Note 5, wherein the first end effector includes a first holding unit, and holds a held unit formed in the applying unit by using the first holding unit to cause the applying unit to be attached thereto.

Note 7. The packing device according to Note 5 or 6, wherein the applying unit includes an adhesive member main body obtained by winding the adhesive member in layers around a ring-shaped core, and the suction unit included in the first end effector is arranged so as to be inserted into the core of the adhesive member main body.

Note 8. The packing device according to any one of Notes 5, 6, and 7, wherein the first work station includes a holder that holds the applying unit.

Note 9. The packing device according to any one of Notes 1 to 8, wherein the second end effector includes a second holding unit, and the second arm unit holds both side surfaces of the packing material in a flat state by using the second holding unit, and takes out the packing material thus held from the first work station.

Note 10. The packing device according to Note 9, wherein a large number of such packing materials in a flat state are stacked on the first work station, the first arm unit lifts a packing material positioned uppermost among the packing materials stacked on the first work station while sucking the packing material by using the suction unit included in the first end effector, and the second arm unit holds, by using the second holding unit, both side surfaces of the packing material lifted by the first arm unit.

Note 11. The packing device according to Note 10, wherein the first work station includes a frame with a flange protruding in a horizontal direction formed in an upper portion, the second arm unit places the packing material taken out from the first work station by using the second holding unit on the flange of the frame, and the first arm unit and the second arm unit perform an operation of developing the packing material and an operation of moving the packing material to the second work station while sucking both side surfaces of the packing material placed on the flange by using the suction unit included in the first end effector and the suction unit included in the second end effector.

Note 12. The packing device according to Note 11, wherein the first arm unit holds down an upper surface of the packing material placed on the flange with the first end effector, and after the first arm unit holds down the packing material placed on the flange, the second arm unit sucks a lower surface of the packing material placed on the flange by using the suction unit included in the second end effector.

Note 13. The packing device according to any one of Notes 4 to 12, wherein the second arm unit holds and extracts the adhesive member of the applying unit included in the first end effector with the second holding unit, and applies the adhesive member thus extracted to the packing material.

Note 14. The packing device according to any one of Notes 1 to 13, wherein the first arm unit and the second arm unit include arm tip portions that hold the first end effector and the second end effector in a rotatable manner, and the first end effector and the second end effector are provided with the suction unit along a rotation axis of the arm tip portion.

Note 15. The packing device according to Note 14, wherein the first arm unit and the second arm unit, after sucking side surfaces positioned opposite to each other of the packing material whose bottom surface is formed by using the suction unit included in the first end effector and the suction unit included in the second end effector, rotate the arm tip portion.

Note 16. The packing device according to Note 4, wherein the second arm unit presses the adhesive member applied to the packing material by the first arm unit.

Note 17. The packing device according to Note 16, wherein the first arm unit starts to apply the adhesive member from a side surface of the packing material to which the inner flap is provided, and the second arm unit presses the pair of outer flaps folded such that end portions thereof come into contact with each other while the first arm unit is applying the adhesive member to the side surface of the packing material to which the inner flap is provided.

Note 18. The packing device according to Note 16 or 17, wherein an operation of storing a product in the packing material whose bottom surface is formed by the outer flaps is performed by using the first arm unit and the second arm unit.

Note 19. The packing device according to Note 18, wherein the first end effector or the second end effector includes a holding unit that holds the product.

Note 20. The packing device according to Note 19, wherein the first arm unit or the second arm unit sucks a liner having a size nearly equal to that of the bottom surface of the packing material by using the suction unit, and drops the liner thus sucked toward the bottom surface of the packing material with the liner tilted with respect to the bottom surface of the packing material.

Note 21. The packing device according to any one of Notes 16 to 20, further comprising:

a third work station in which the operation of storing the product is performed, wherein the packing material whose bottom surface is formed by the outer flaps is moved from the second work station to the third work station by using the first arm unit and the second arm unit.

Note 22. The packing device according to any one of Notes 1 to 21, wherein the suction unit included in the first end effector and the suction unit included in the second end effector suck side surfaces positioned opposite to each other when the packing material is developed three-dimensionally among side surfaces of the packing material in a flat state.

Note 23. The packing device according to any one of Notes 1 to 22, wherein the first arm unit and the second arm unit are arm units included in one dual-arm robot.

What is claimed is:

1. A packing device comprising:

a first work station on which a packing material in a flat state is placed;

a second work station on which the packing material developed three-dimensionally is placed; and a robot that performs an operation of developing the packing material and an operation of moving the packing material, wherein the robot comprises:

a first end effector and a second end effector each including a suction unit that sucks an object; and a first arm unit that includes the first end effector and a second arm unit that includes the second end effector;

wherein the robot performs the operation of developing the packing material and the operation of moving the packing material to the second work station by using the first arm unit and the second arm unit while both side surfaces of the flat-state packing material placed on the first work station are being sucked by using the suction unit included in the first end effector and the suction unit included in the second end effector, the both side surfaces being opposite to each other when the packing material is developed three-dimensionally, and the robot moves at least one of the first arm unit and the second arm unit in a direction that is at an oblique angle to the side surfaces of the flat-state packing material to perform the operation of developing the packing material after sucking the both side surfaces of the flat-sate packing material.

2. The packing device according to claim 1, wherein after the packing material is moved to the second work station, flaps provided to side surfaces of the packing material are folded toward an inside of the packing material by using the first arm unit and the second arm unit.

3. The packing device according to claim 2, wherein the second work station includes a pressing unit that presses a side surface of the packing material to which an outer flap serving as a flap that forms a bottom surface of the packing material among the flaps is provided from an outside of the packing material, and the first arm unit and the second arm unit fold a pair of inner flaps serving as flaps positioned on an inner side of the packing material than the outer flap among the flaps toward the inside of the packing material pressed by the pressing unit.

4. The packing device according to claim 3, wherein the first end effector includes an applying unit that applies a predetermined adhesive member, and the first arm unit applies the predetermined adhesive member to both end portions of a pair of such outer flaps folded such that the end portions come into contact with each other by using the applying unit.

5. The packing device according to claim 4, wherein the applying unit is attached to the first end effector in a detachable manner.

6. The packing device according to claim 5, wherein the first end effector includes a first holding unit, and holds a held unit formed in the applying unit by using the first holding unit to cause the applying unit to be attached thereto.

7. The packing device according to claim 5, wherein the applying unit includes an adhesive member main body obtained by winding the adhesive member in layers around a ring-shaped core, and the suction unit included in the first end effector is arranged so as to be inserted into the core of the adhesive member main body.

8. The packing device according to claim 5, wherein the first work station includes a holder that holds the applying unit.

9. The packing device according to claim 4, wherein the second arm unit presses the adhesive member applied to the packing material by the first arm unit.

10. The packing device according to claim 9, wherein the first arm unit starts to apply the adhesive member from a side surface of the packing material to which the inner flap is provided, and the second arm unit presses the pair of outer flaps folded such that end portions thereof come into contact with each other while the first arm unit is applying the adhesive member to the side surface of the packing material to which the inner flap is provided.

11. The packing device according to claim 9, wherein an operation of storing a product in the packing material whose bottom surface is formed by the outer flaps is performed by using the first arm unit and the second arm unit.

12. The packing device according to claim 1, wherein the first end effector includes a first holding unit and the second end effector includes a second holding unit, and the second arm unit holds both of the side surfaces of the flat-state packing material by using the second holding unit, and takes out the packing material thus held from the first work station.

13. The packing device according to claim 12, wherein a large number of such packing materials in a flat state are stacked on the first work station, the first arm unit lifts a packing material positioned uppermost among the packing materials stacked on the first work station while sucking the packing material by using the suction unit included in the first end effector, and the second arm unit holds, by using the second holding unit, both side surfaces of the packing material lifted by the first arm unit.

14. The packing device according to claim 13, wherein the first work station includes a frame with a flange protruding in as horizontal direction formed in an upper portion, the second arm unit places the packing material taken out from the first work station by using the second holding unit on the flange of the frame, and the first arm unit and the second arm unit perform an operation of developing the packing material and an operation of moving the packing material to the second work station while sucking both side surfaces of the packing material placed on the flange by using the suction unit included in the first end effector and the suction unit included in the second end effector.

15. The packing device according to claim 14, wherein the first arm unit holds down an upper surface of the packing material placed on the flange with the first end effector, and after the first arm unit holds down the packing material placed on the flange, the second arm unit sucks a lower surface of the packing material placed on the flange by using the suction unit included in the second end effector.

16. The packing device according to claim 1, wherein the first arm unit and the second arm unit include arm tip portions that hold the first end effector and the second end effector in a rotatable manner, and the first end effector and the second end effector are provided with the suction unit along a rotation axis of the arm tip portion.

17. The packing device according to claim 16, wherein the first arm unit and the second arm unit, after sucking side surfaces positioned opposite to each other of the packing material whose bottom surface is formed by using the suction unit included in the first end effector and the suction unit included in the second end effector, rotate the arm tip portion.

18. The packing device according to claim 1, wherein the suction unit included in the first end effector and the suction unit included in the second end effector suck side surfaces positioned opposite to each other when the packing material is developed three-dimensionally among side surfaces of the packing material in a flat state.

19. The packing device according to claim 1, wherein the robot moves both of the first arm unit and the second arm unit in directions that are not perpendicular to the side surfaces of the flat-state packing material to perform the operation of developing the packing material after sucking the both side surfaces of the flat-state packing material.

20. The packing device according to claim 1, wherein the robot performs the operation of moving the packing material from the first work station to the second work station while performing the operation of developing the packing material.

21. The packing device according to claim 1, wherein after the packing material is moved to the second work station, the robot folds flaps provided to the side surfaces of the packing material toward an inside of the packing material by using the first end effector of the first arm unit and the second end effector of the second arm unit.

22. A packing device comprising:

a first work station on which a packing material in a flat state is placed;

a first end effector and a second end effector including a suction unit that sucks an object;

a first arm unit that includes the first end effector and a second arm unit that includes the second end effector; and a second work station on which the packing material developed three-dimensionally is placed, wherein an operation of developing the packing material and an operation of moving the packing material to the second work station are performed by using the first arm unit and the second arm unit while both side surfaces of the packing material placed on the first work station are being sucked by using the suction unit included in the first end effector and the suction unit included in the second end effector, wherein the first end effect includes a first holding unit and the second end effector includes a second holding unit, and the second arm unit holds both of the side surfaces of the flat-state packing material by using the second holding unit, and takes out the packing material thus held from the first work station, and wherein the first end effector includes an applying unit that applies a predetermined adhesive member, and the second arm unit holds and extracts the adhesive member of the applying unit included in the first end effector with the second holding unit, and applies the adhesive member thus extracted to the packing material.

23. A packing device comprising:

a first placing unit on which a packing material in a flat state is placed;

a second placing unit on which the packing material developed three-dimensionally is placed; and a robot that performs an operation of developing the packing material and an operation of moving the packing material, wherein a robot comprises:

a first suction unit and a second suction unit that each suck an object; and a first arm unit that includes the first suction unit and a second arm unit that includes the second suction unit;

wherein the robot performs the operation of developing the packing material and the operation of moving the packing material to the second placing unit by using the first arm unit and the second arm unit while both side surfaces of the flat-state packing material placed on the first placing unit are being sucked by using the first suction unit and the second suction unit, the both side surfaces being opposite to each other when the packing material is developed three-dimensionally, and the robot moves at least one of the first arm unit and the second arm unit in a direction that is at an oblique angle to the side surfaces of the flat-state packing material to perform the operation of developing the packing material after sucking the both side surfaces of the flat-state packing material.

* * * * *